US008299883B2

(12) United States Patent
Katsumata et al.

(10) Patent No.: US 8,299,883 B2
(45) Date of Patent: Oct. 30, 2012

(54) LAMINATED INDUCTIVE DEVICE

(75) Inventors: Shin Katsumata, Rockford, IL (US); Stephen George Mican, West Point, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 0 days.

(21) Appl. No.: 12/731,898

(22) Filed: Mar. 25, 2010

(65) Prior Publication Data

US 2011/0234358 A1 Sep. 29, 2011

(51) Int. Cl.
*H01F 5/00* (2006.01)
*H01F 27/28* (2006.01)

(52) U.S. Cl. ..... 336/200; 336/222; 336/223

(58) Field of Classification Search ..... 336/192, 336/200, 223, 232, 222
See application file for complete search history.

(56) References Cited

U.S. PATENT DOCUMENTS 5,892,668 A * 4/1999 Okamoto et al. ..... 363/40
6,438,000 B1 * 8/2002 Okamoto et al. ..... 363/40
6,768,229 B2 7/2004 Rafaelof et al.
7,446,638 B2 * 11/2008 Nogi ..... 336/200
2003/0127915 A1 7/2003 Rafaelof et al.
2006/0006972 A1 * 1/2006 Tozawa et al. ..... 336/200
2007/0296536 A1 * 12/2007 Odahara et al. ..... 336/200
2008/0303622 A1 * 12/2008 Park et al. ..... 336/200
2009/0085706 A1 * 4/2009 Baarman et al. ..... 336/200
2009/0243781 A1 10/2009 Nomura et al.
2009/0243784 A1 * 10/2009 Iwasaki ..... 336/200

* cited by examiner

*Primary Examiner* — Mohamad Musleh
*Assistant Examiner* — Mangtin Lian
(74) *Attorney, Agent, or Firm* — Stephen G. Mican

(57) ABSTRACT

An inductive electrical device comprises multiple laminations, each lamination comprising: a generally planar electrically nonconductive substrate that has a central axis normal to its plane, a first surface and a second surface; at least one electrically conductive layer pattern along the first surface in the form of a narrow strip that starts from a first point displaced from the central axis and extends along the first surface about the central axis through a first angle of rotation to a second point; a least one electrically conductive layer pattern along the second surface in the form of a narrow strip that starts from the second point and extends along the second surface about the central axis through a second angle of rotation to at least the first point; an electrically conductive coupling region passing through the substrate proximate the second point that couples the electrically conductive layer pattern along the first surface to the electrically conductive layer pattern along the second surface; wherein stacking the laminations upon each other form at least one winding with multiple turns for the inductive device.

18 Claims, 41 Drawing Sheets

LAMINATED INDUCTIVE DEVICE

DETAILED DESCRIPTION OF THE EMBODIMENTS

Figure 1:
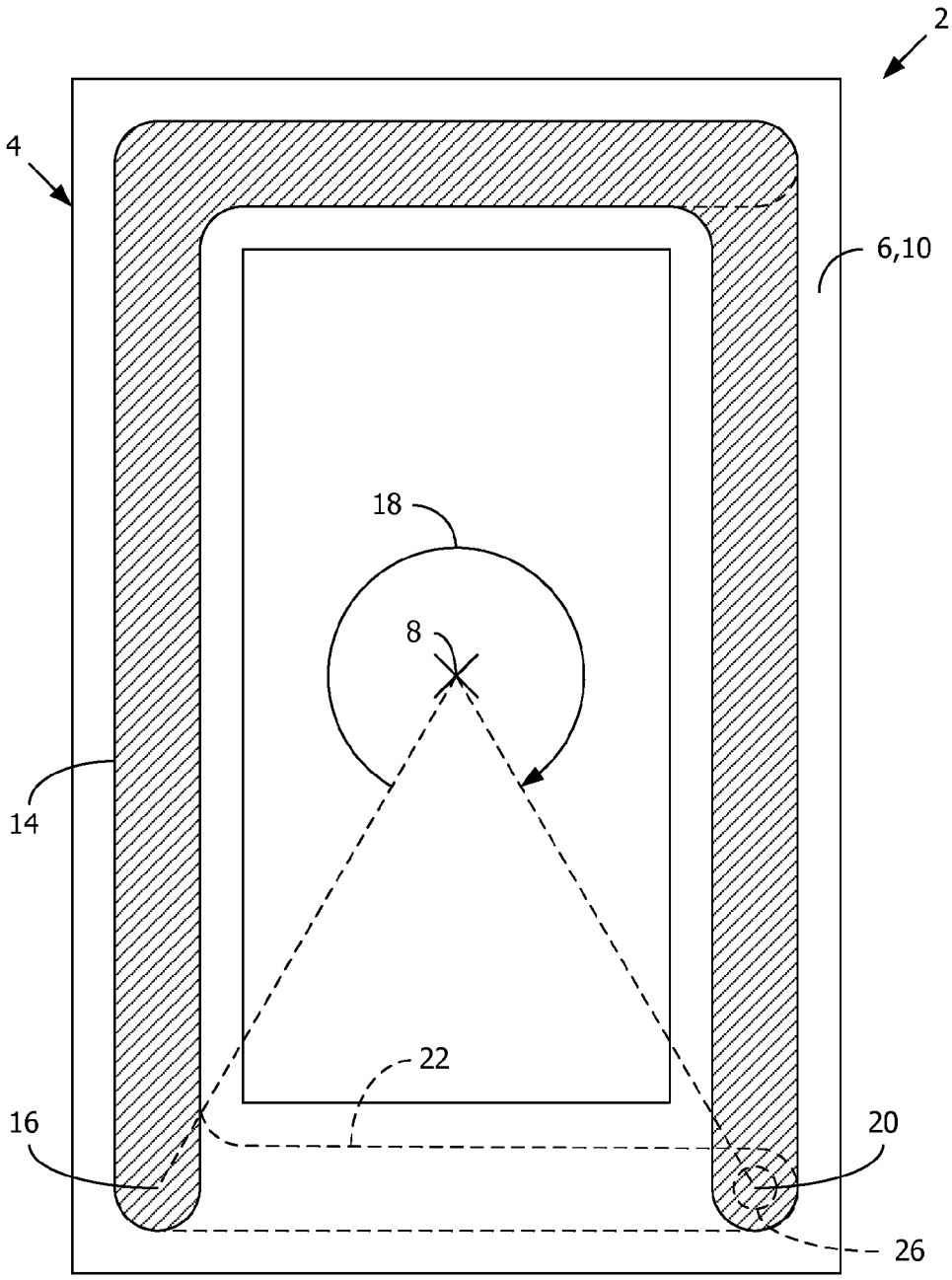
FIG. 1 is a top view of a first lamination of a laminated electrically inductive device according to a first embodiment.

Referring to FIGS. 1 through 9 together, a laminated electrically inductive device 2 according to a first possible embodiment comprises multiple laminations 4. Each lamination 4 comprises a generally planar electrically nonconductive substrate 6 that has a central axis 8 normal to its plane, a first surface 10 and a second surface 12. The substrate 6 may comprise any suitable electrically nonconductive material. For purposes of electrical and mechanical stability during high temperature operation, the substrate 6 may comprise a ceramic sheet.

Referring to FIG. 1 in particular, the first surface 10 of each substrate 6 has at least one electrically conductive pattern 14 in the form of a narrow strip that starts from a first point 16 displaced from the central axis 8 and extends along the first surface 10 about the central axis 8 through a first angle of rotation 18 to a second point 20. The first surface conductive pattern 14 may comprise any convenient plating, cladding or film applied to the substrate 6, such as copper, aluminium or any alloy thereof.

Figure 2:
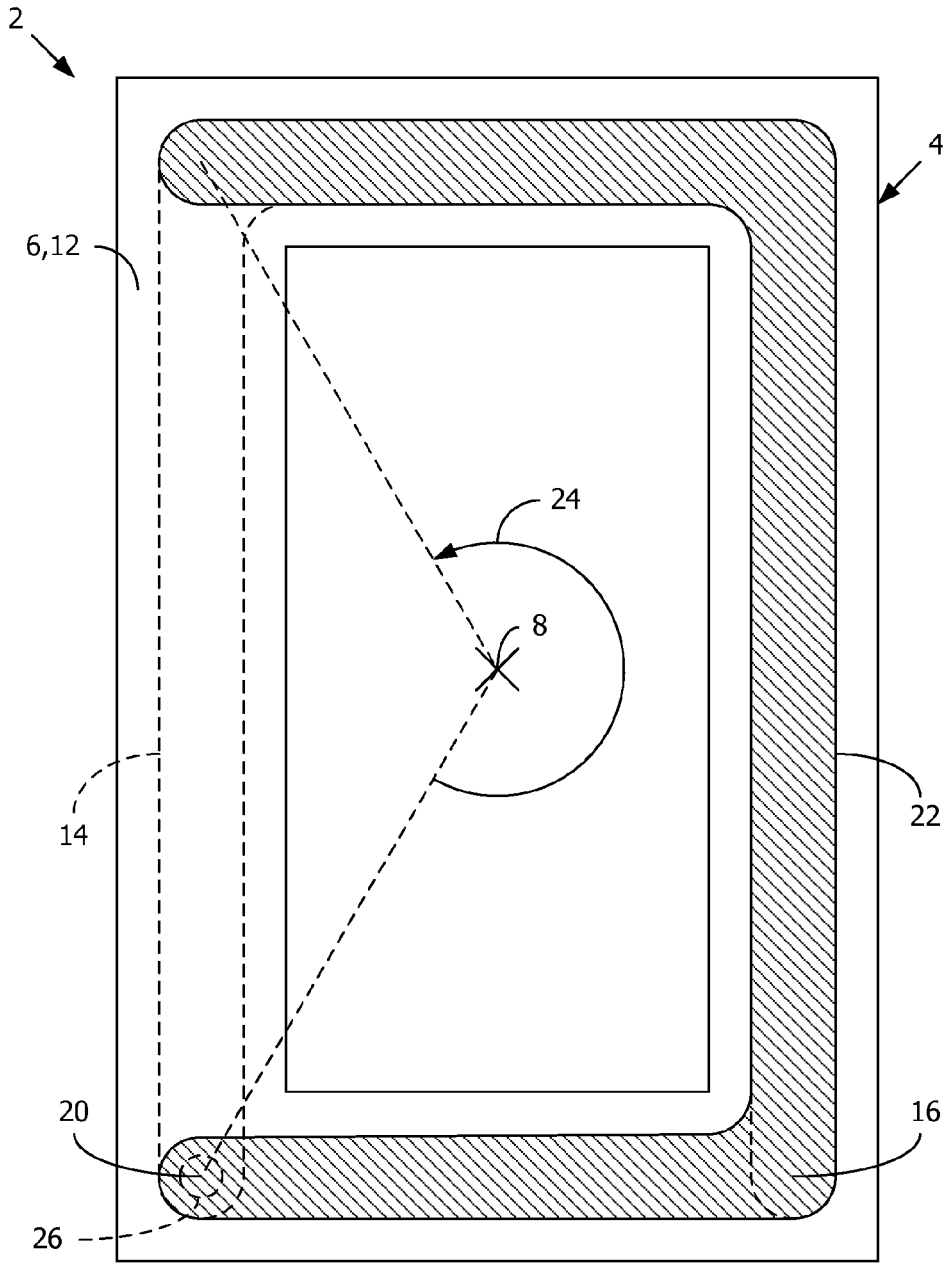
FIG. 2 is a bottom view of the first lamination of the first embodiment shown in FIG. 1.

Referring to FIG. 2 in particular, the second surface 12 of each substrate 6 has at least one electrically conductive pattern 22 in the form of a narrow strip that starts from the second point 20 displaced from the central axis 8 and extends along the second surface 12 about the central axis 8 through a second angle of rotation 24 to at least the first point 16. The second surface conductive pattern 22 may comprise any convenient plating, cladding or film applied to the substrate 6, such as copper, aluminium or any alloy thereof.

Referring to FIGS. 1 and 2 together in particular, an electrically conductive coupling region 26 passing through the substrate 6 proximate the second point 20 couples the first surface pattern 14 to the second surface pattern 22. The coupling region 26 may simply be an aperture that allows the first surface pattern 14 to make electrical contact with the second surface pattern 22 at the second point 20, or it may otherwise be a conductive inlay in the substrate 6 or even a connecting member, such as an electrically conductive rivet, that passes through an aperture in the substrate 6.

Figure 3:
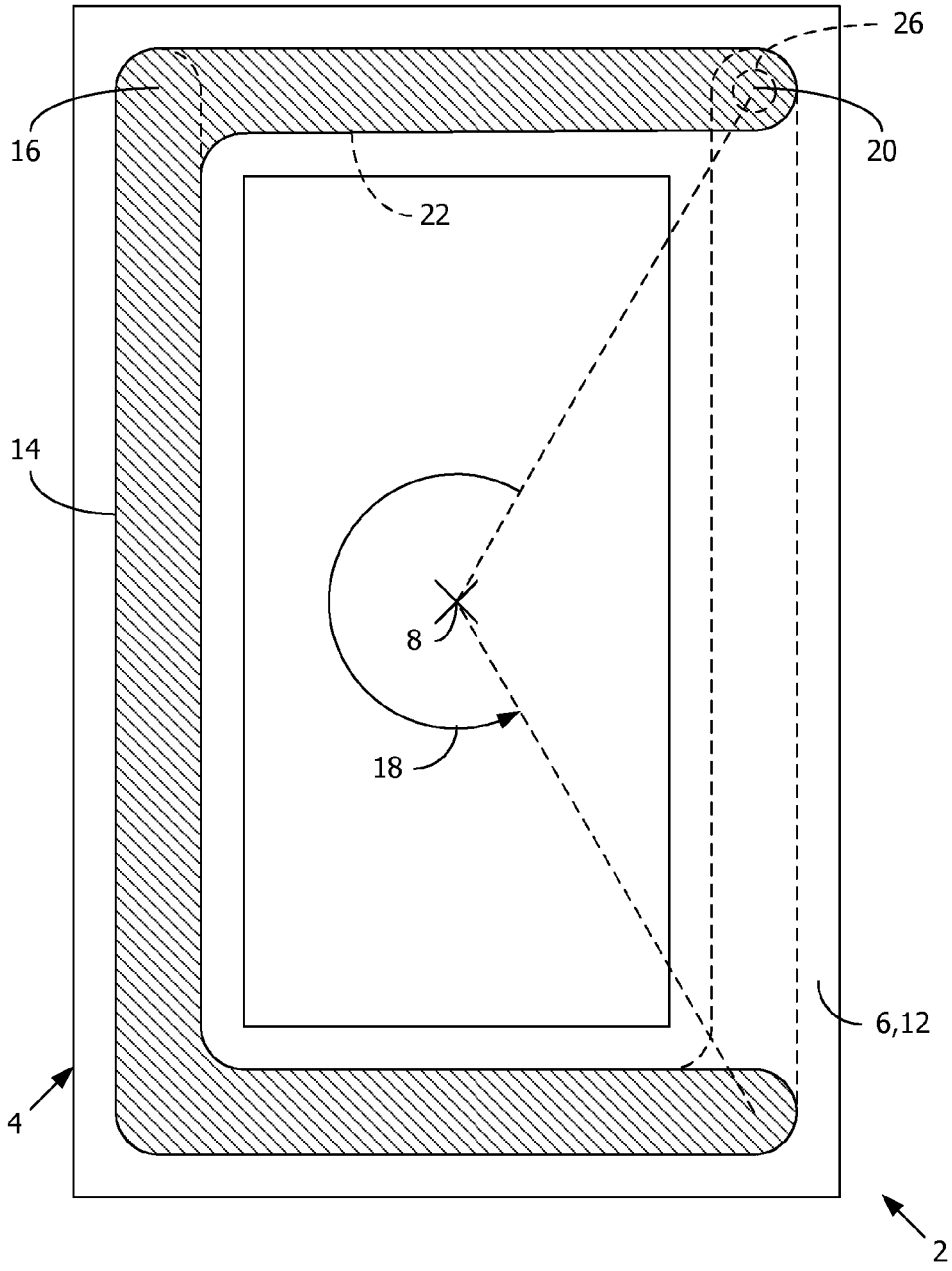
FIG. 3 is a top view of a second lamination of the first embodiment.
Figure 4:
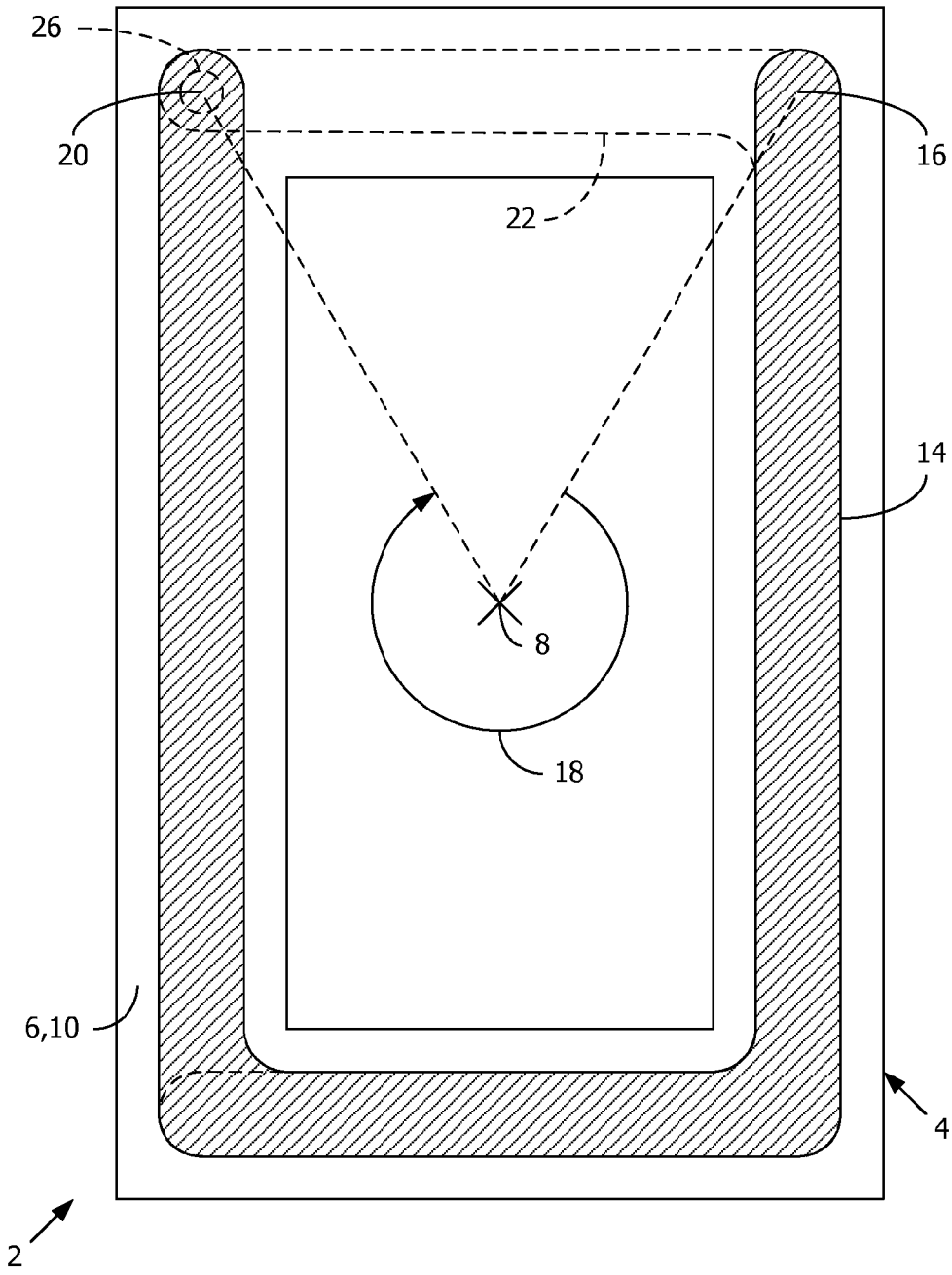
FIG. 4 is a bottom view of the second lamination of the first embodiment shown in FIG. 3.
Figure 5:
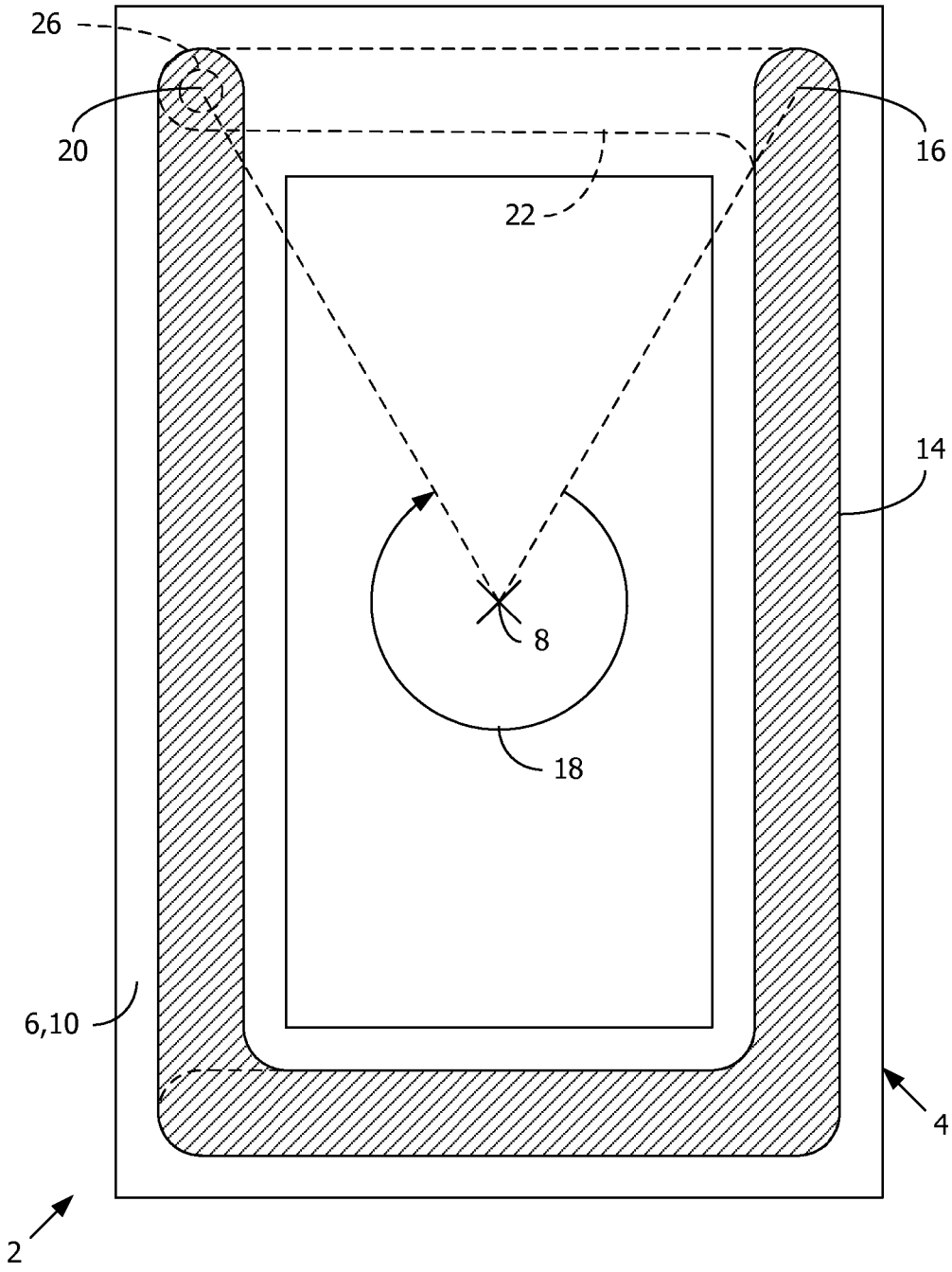
FIG. 5 is a top view of a third lamination of the first embodiment.
Figure 6:
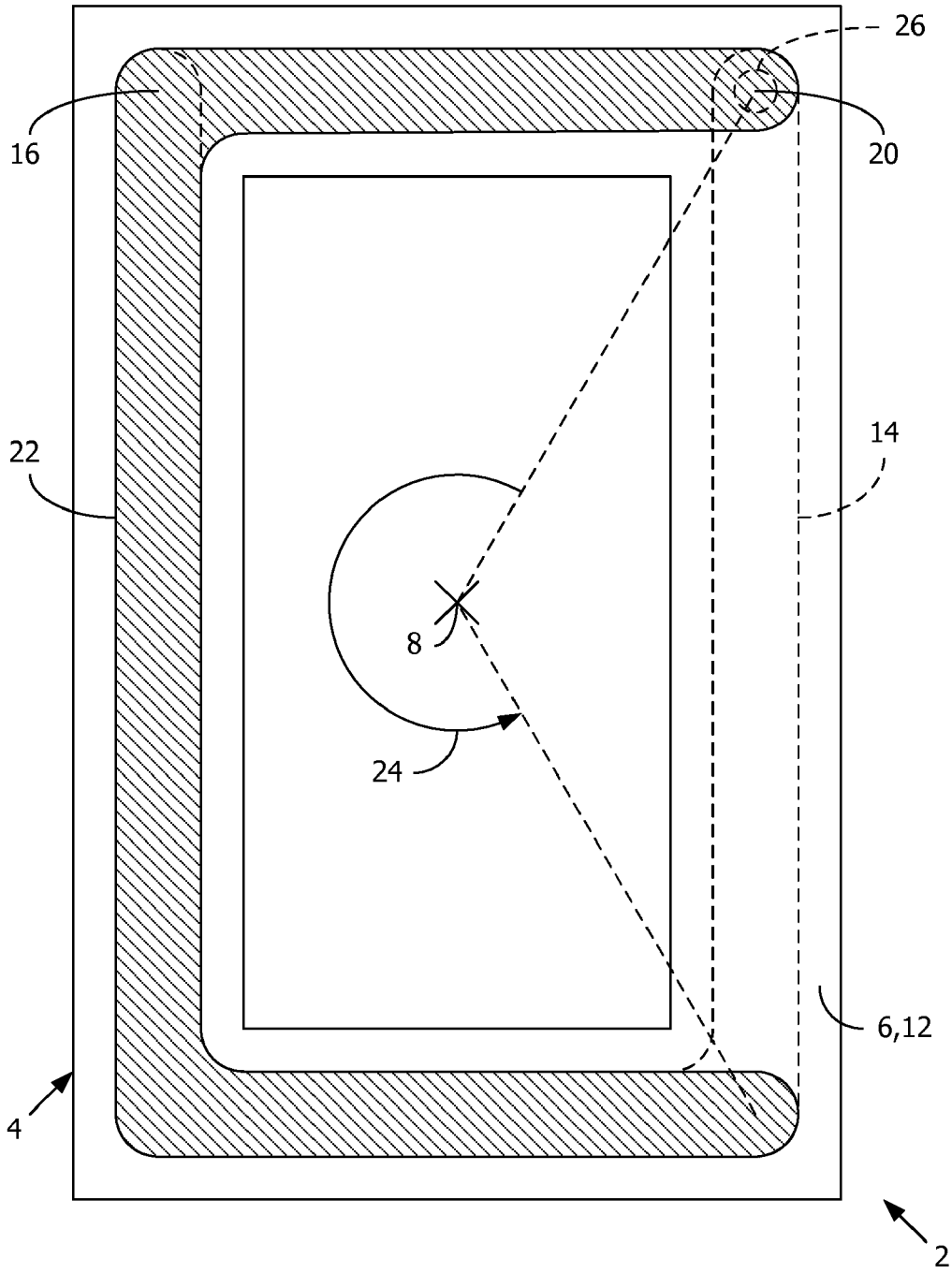
FIG. 6 is a bottom view of third lamination of the first embodiment shown in FIG. 5.
Figure 7:
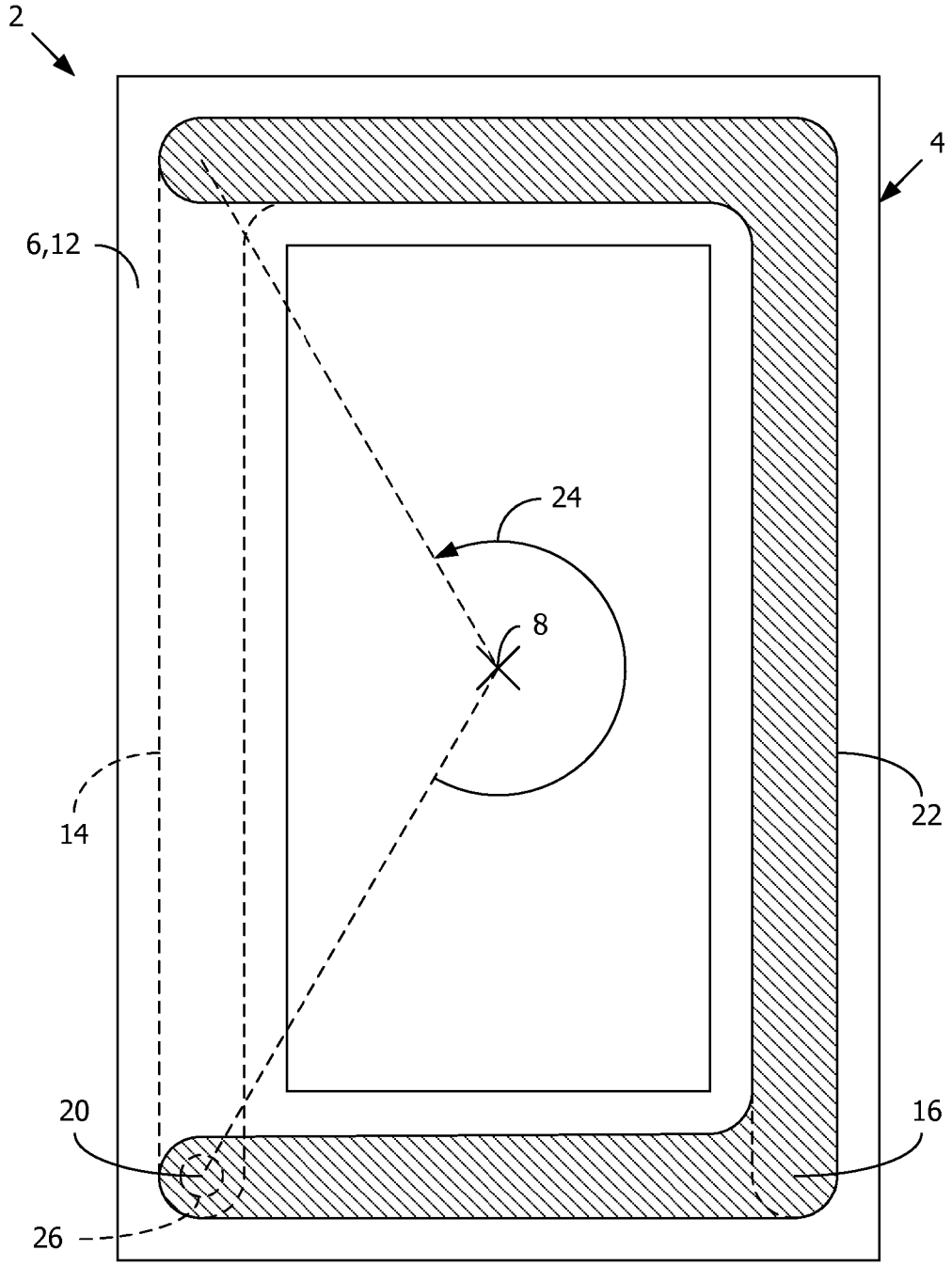
FIG. 7 is a top view of a fourth lamination of the first embodiment.
Figure 8:
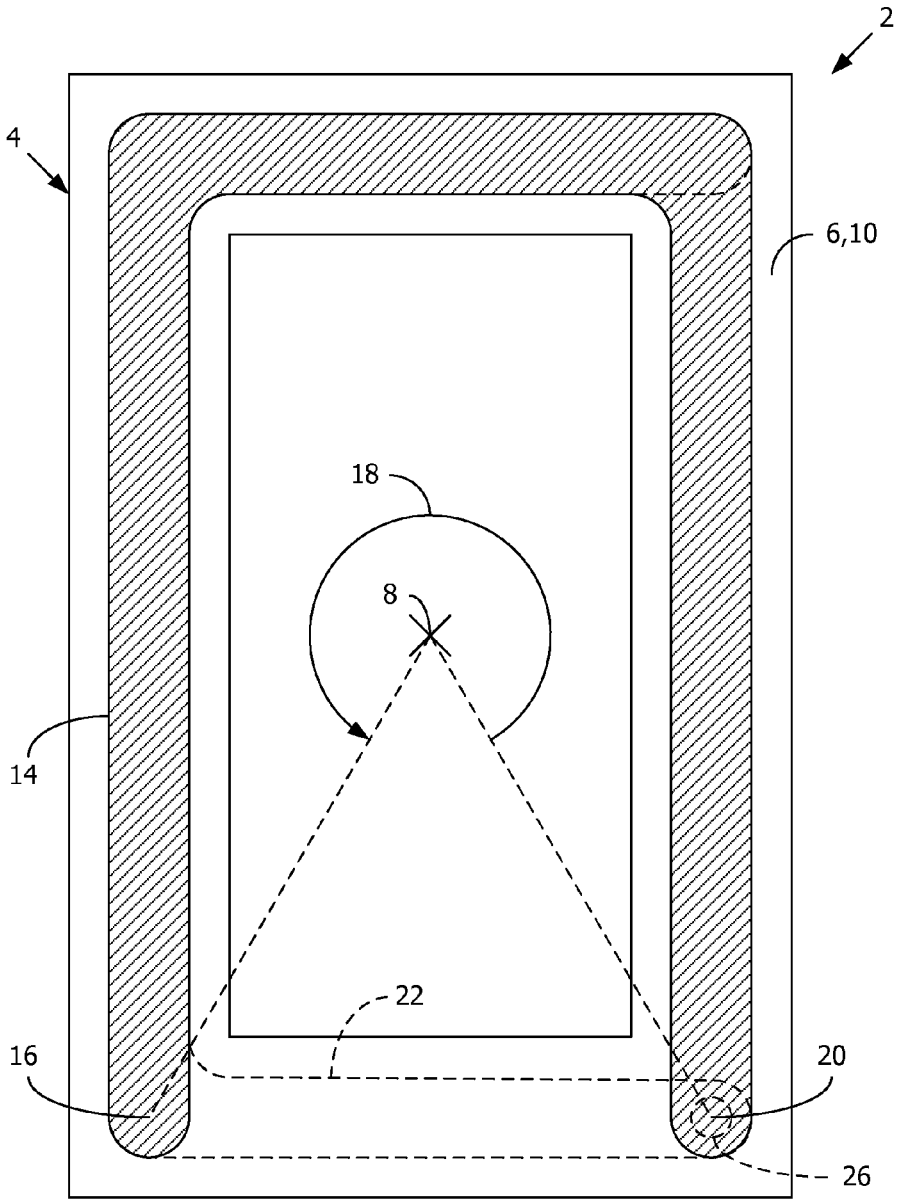
FIG. 8 is a bottom view of the fourth lamination of the first embodiment shown in FIG. 7.
Figure 9:
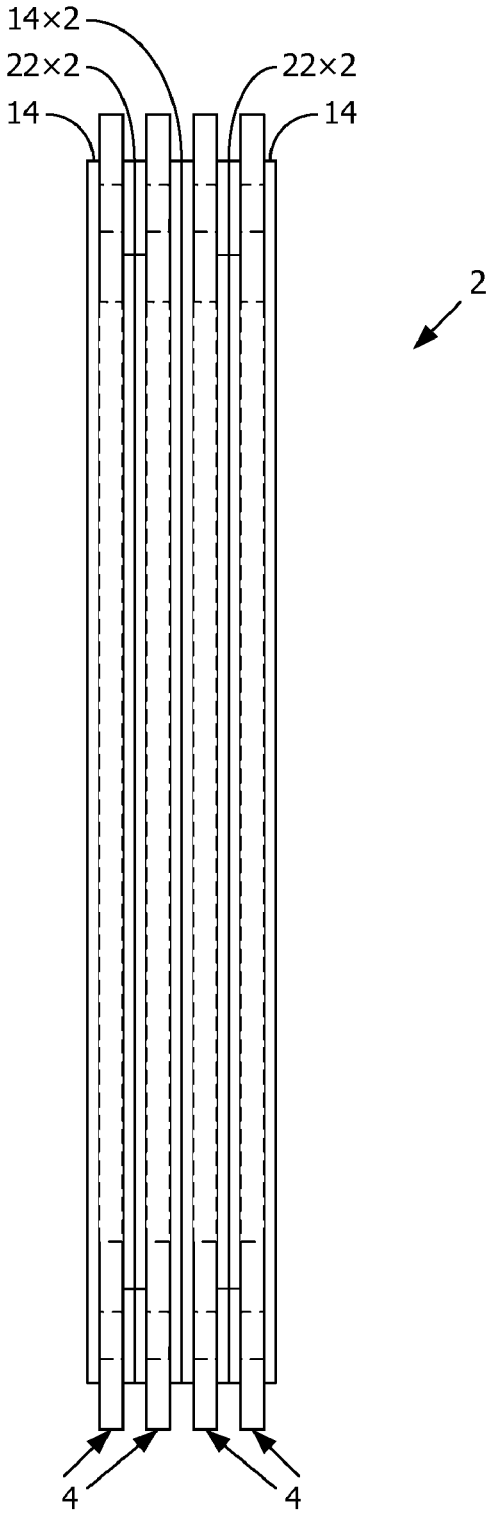
FIG. 9 is a side view of the first embodiment of the laminated electrically inductive device that shows the four laminations of the laminated inductive device stacked together.

FIG. 9 shows the laminated electrically inductive device 2 with four of the laminations 4 stacked together. The laminated electrically inductive device 2 may comprise any number of the laminations 4. FIG. 1 represents a top view of a first lamination 4 of the laminated electrically inductive device 2. FIG. 2 represents a bottom view of the first lamination 4 of the laminated electrically inductive device 2. FIG. 3 represents a top view of a second lamination 4 of the laminated electrically inductive device 2. FIG. 4 represents a bottom view of the second lamination 4 of the laminated electrically inductive device 2. FIG. 5 represents a top view of a third lamination 4 of the laminated electrically inductive device 2. FIG. 6 represents a bottom view of the third lamination 4 of the laminated electrically inductive device 2. FIG. 7 represents a top view of a fourth lamination 4 of the laminated electrically inductive device 2. FIG. 8 represents a bottom view of the fourth lamination 4 of the laminated electrically inductive device 2.

It is necessary for the adjacent laminations 4 in the laminated electrically inductive device 2 to have matching electrically conductive patterns, represented by the first surface pattern 14 and the second surface pattern 22. In the case, as in the first embodiment, wherein the first surface pattern 14 and the second surface pattern 22 are not symmetrical, it is necessary to match the same types of surface patterns on the adjacent laminations 4. Therefore, the top view of the second lamination 4, as shown in FIG. 3, shows the second surface 12 of the substrate 6 so that its second surface pattern 22 mates with the second surface pattern 22 along the second surface 12 of the first lamination 4 as shown in FIG. 2. Likewise the top view of the fourth lamination 4, as shown in FIG. 7, shows the second surface 12 of the substrate 6 so that its second surface pattern 22 mates with the second surface pattern 22 along the second surface 12 of the first lamination 4 as shown in FIG. 6.

In the first embodiment, the first surface pattern 14 along the first surface 10 and the second surface pattern 22 along the second surface 12 together form a closed planar shape. This shape may be rectangular, as shown, in which case the first surface pattern 14 is not symmetric with the second surface pattern 22, or alternatively may have almost any closed form that comprises rectilinear outer sides, such a triangle, square, hexagon, and so forth, or at least one curvilinear side, such as a circle or pincushion shape. Shapes such as a square, hexagon and circle may have the first surface pattern 14 symmetric with the second surface pattern 22, so that the surfaces of the substrates 6 for the laminations 4 that mate are not important. The surface patterns 14 and surface patterns 22 of adjacent laminations 4 may bond together by compression, diffusion bonding or other means.

The first surface pattern 14 and the second surface pattern 22 for each lamination 4 form a complete turn of a winding for the laminated electrically inductive device 2. For such a single layer winding structure, all the laminations 4 may be of a single type. Since the first embodiment of the laminated electrically inductive device 2 as shown in FIGS. 1 through 9 has four laminations 4, it therefore comprises an electrical inductor that has a single layer winding of four turns. Of course, the inductive device 2 may have a lesser number of laminations 4 or a greater number of laminations 4 to achieve a lesser or greater degree of desired electrical inductance.

Figure 10:
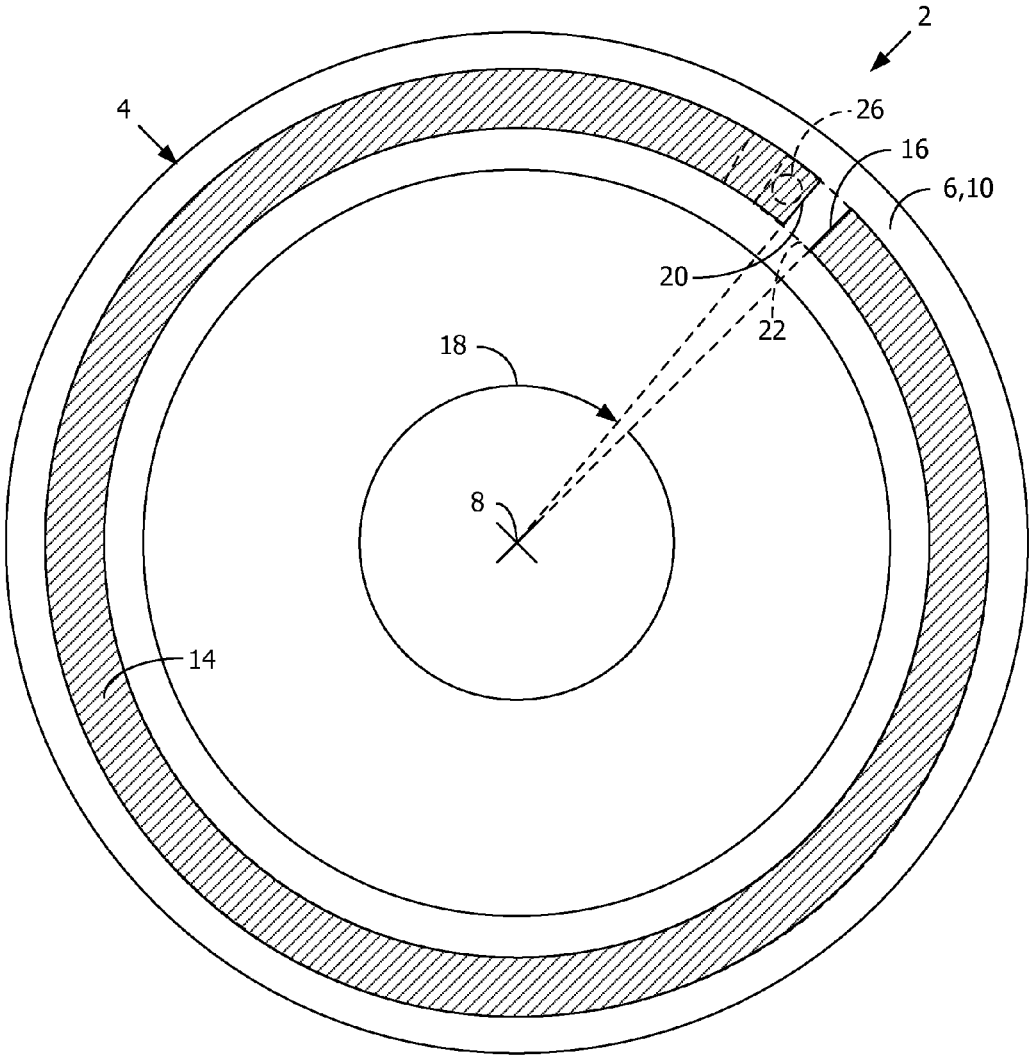
FIG. 10 is a top view of a first lamination of a laminated electrically inductive device according to a second embodiment.
Figure 11:
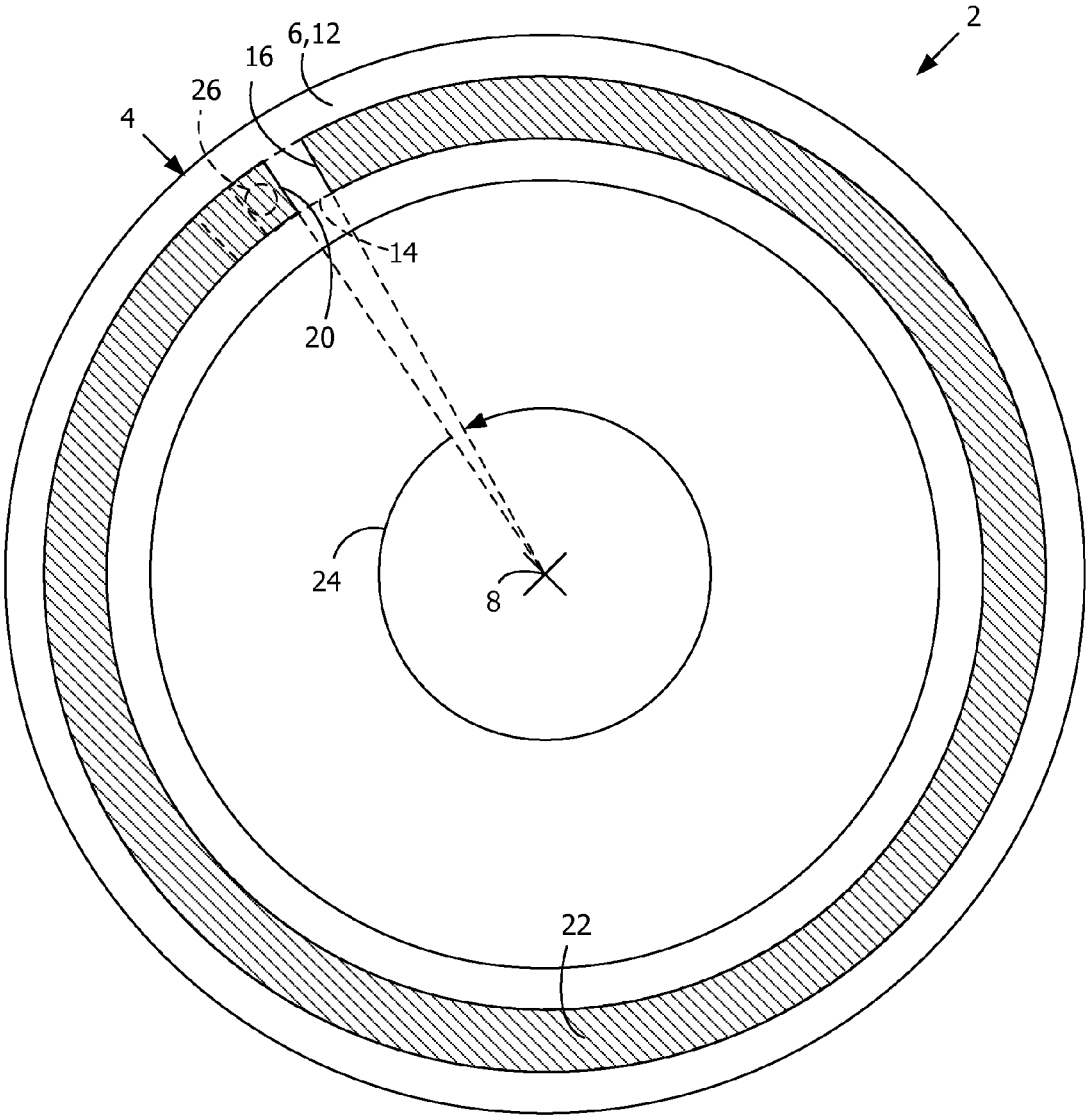
FIG. 11 is a bottom view of the first lamination of the second embodiment shown in FIG. 10.
Figure 12:
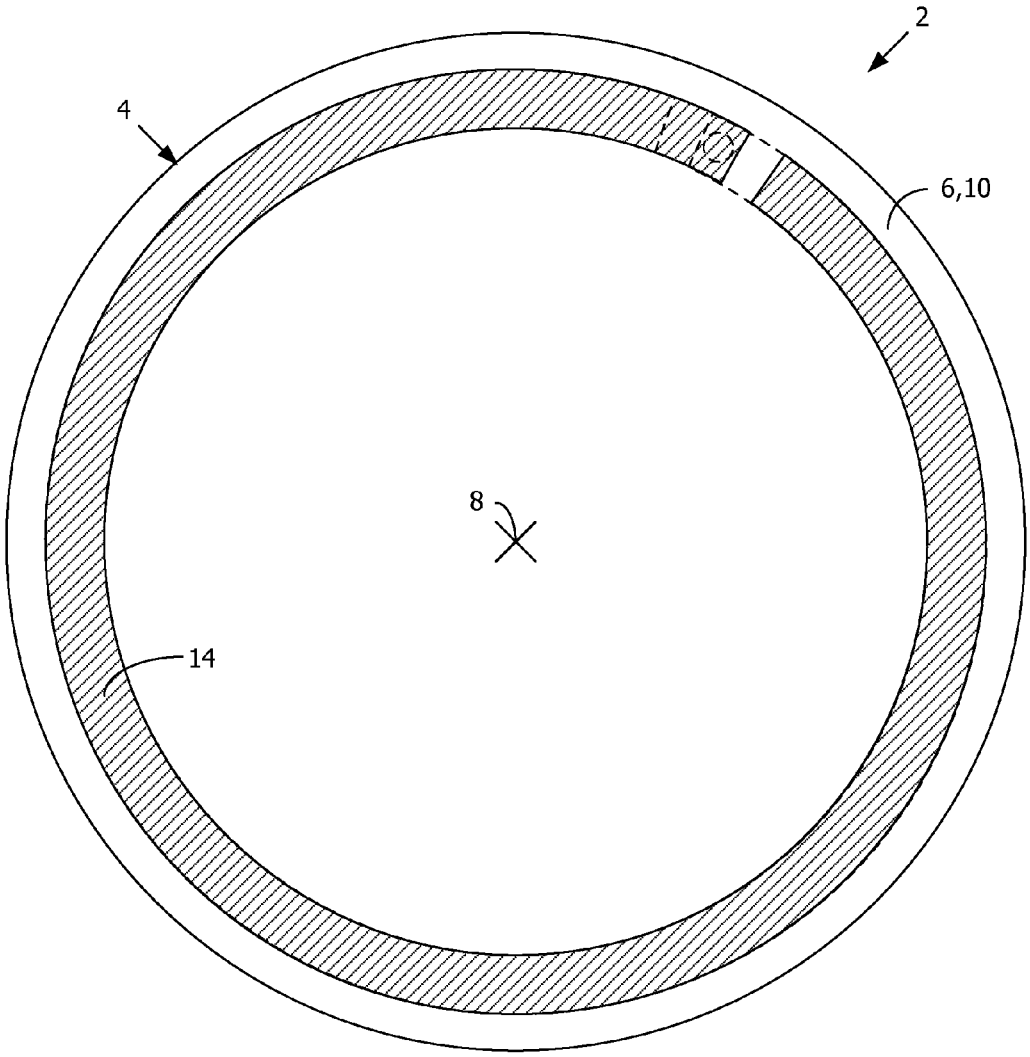
FIG. 12 is a top view of a second lamination of the second embodiment.
Figure 13:
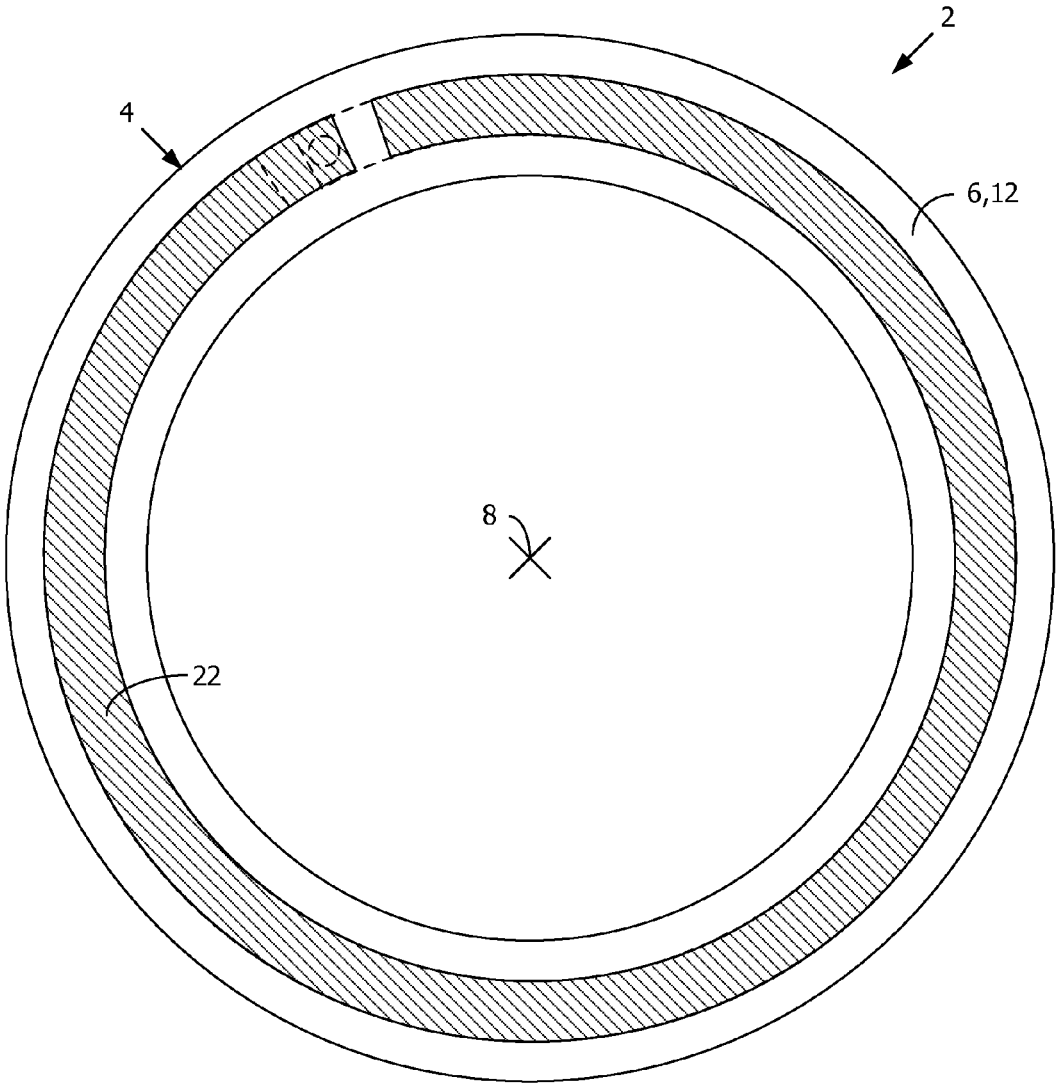
FIG. 13 is a bottom view of the second lamination of the second embodiment shown in FIG. 12.
Figure 14:
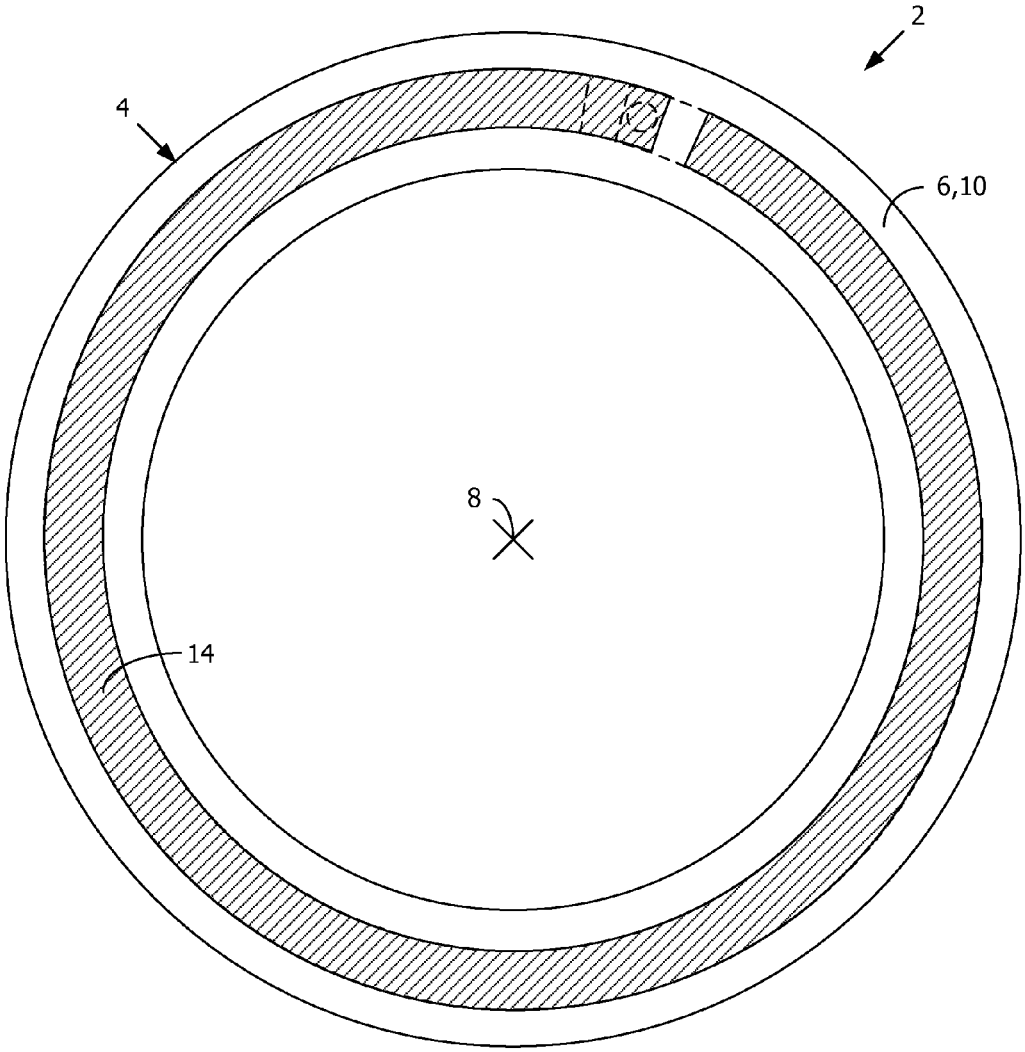
FIG. 14 is a top view of a third lamination of the second embodiment.
Figure 15:
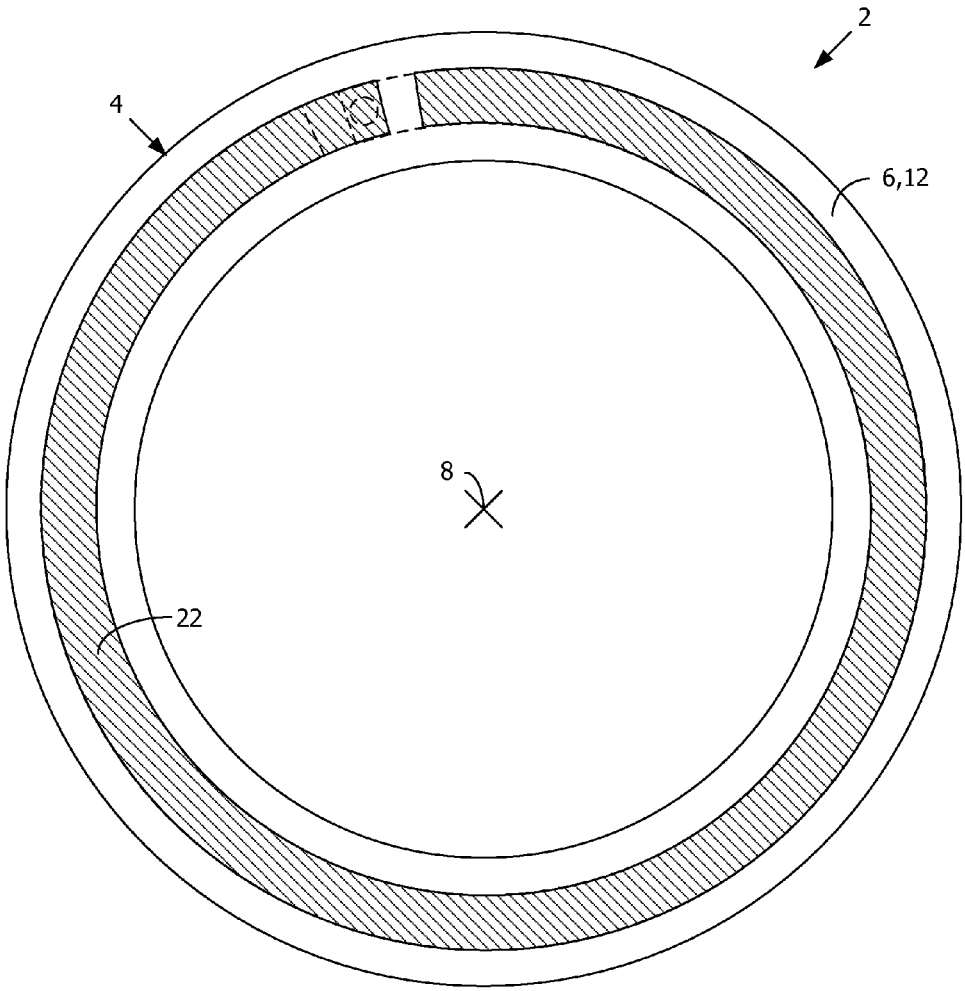
FIG. 15 is a bottom view of third lamination of the second embodiment shown in FIG. 14.
Figure 16:
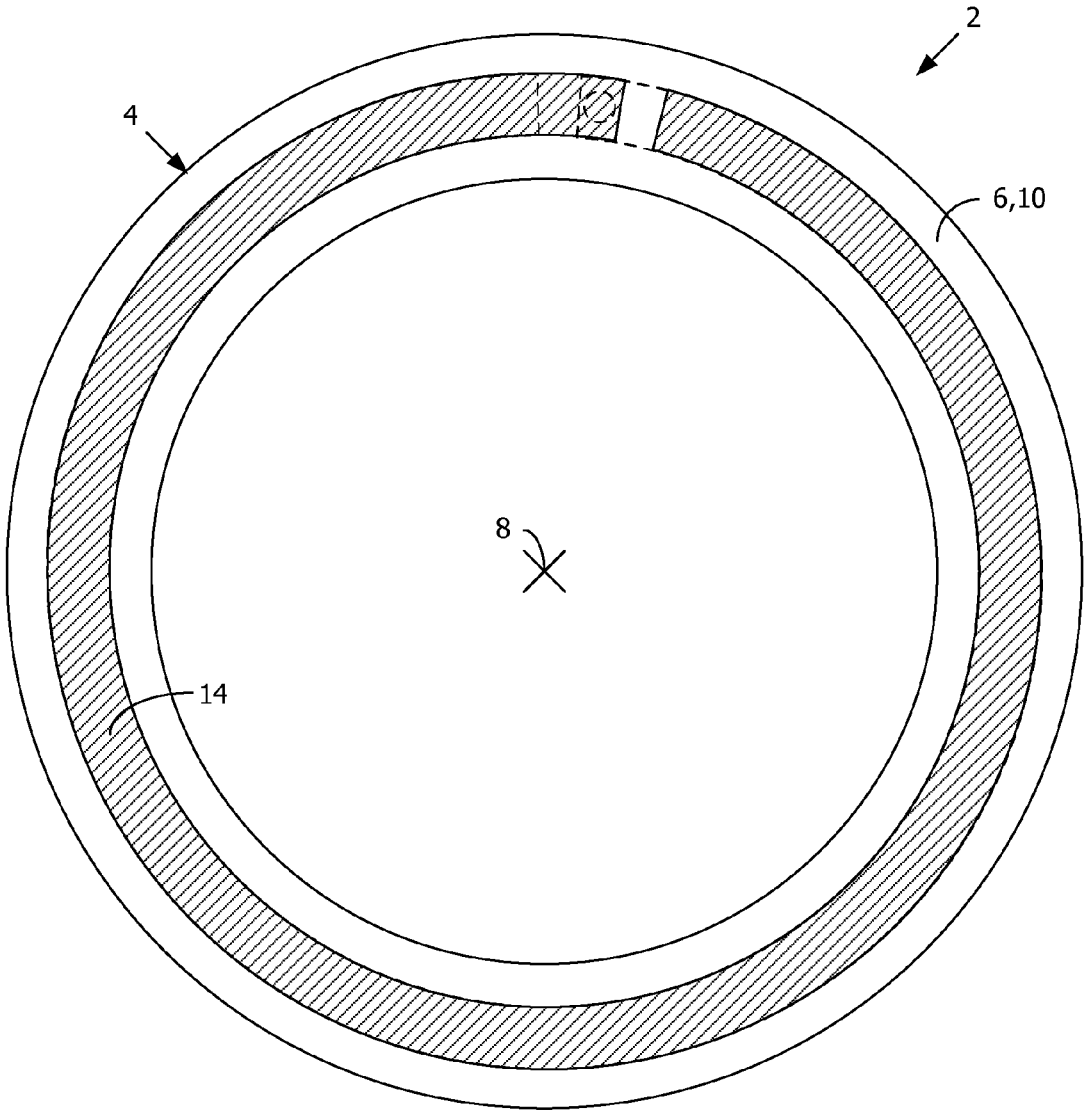
FIG. 16 is a top view of a fourth lamination of the second embodiment.
Figure 17:
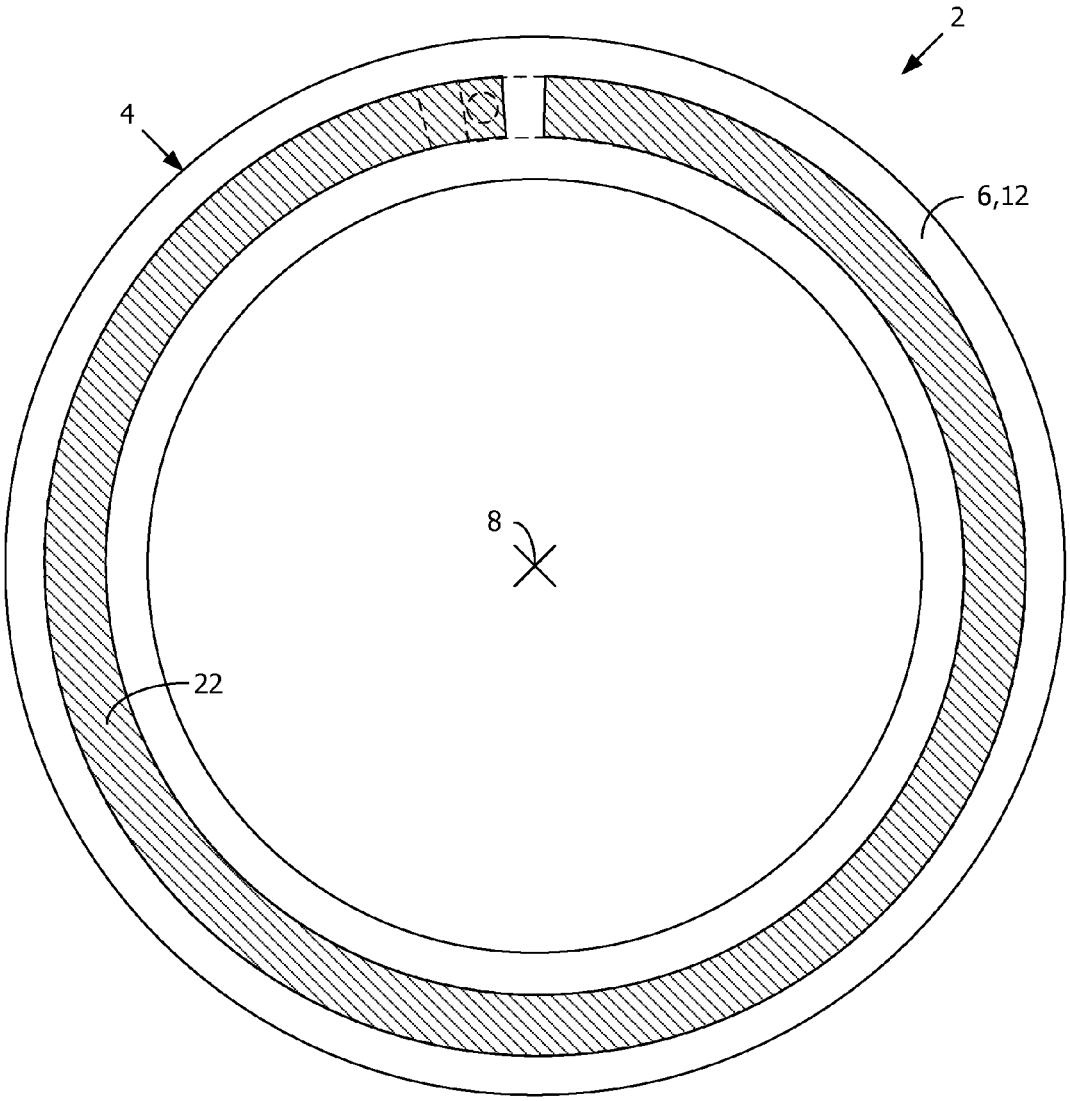
FIG. 17 is a bottom view of the fourth lamination of the second embodiment shown in FIG. 16.

Referring to FIGS. 10 through 17 together, the laminated electrically inductive device 2 according to a second possible embodiment again comprises multiple laminations 4. In this embodiment, for each lamination 4 the first surface pattern 14 along the first surface 10 of the substrate 6 and the second surface pattern 22 along the second surface 12 of the substrate 6 are both generally circular, and together they form a closed circular pattern so that they form a complete turn of a winding for the laminated electrically inductive device 2. Although FIG. 10 shows the first surface pattern 14 extending through the first angle of rotation 18 approaching 360 degrees and FIG. 11 shows the second surface pattern 22 extending through the second angle of rotation approaching 360 degrees, both the first angle of rotation 18 and the second angle of rotation 24 may be smaller, and in fact may be as little as approximately 180 degrees each.

Since the second embodiment of the laminated electrically inductive device 2 has laminations 4 with first surface patterns 14 and second surface patterns 22 that are identical, there is no need to match the same types of surface patterns on the adjacent laminations 4. Thus, in FIGS. 10 through 17, it is evident that in fact adjacent laminations 4 couple first surface patterns 14 with second surface patterns 22. It is only necessary to rotate adjacent laminations 4 relative to each other so that their respective surface patterns line up. Just as with the first embodiment of the laminated electrically inductive device 2, the first surface pattern 14 and the second surface pattern 22 for each lamination 4 form a complete turn of a winding for the laminated electrically inductive device 2. Since the second embodiment of the laminated electrically inductive device 2 as shown in FIGS. 10 through 17 has four laminations 4, it therefore comprises an electrical inductor that has a single layer winding of four turns. Of course, just as with the first embodiment, the inductive device 2 may have a lesser number of laminations 4 or a greater number of laminations 4 to achieve a lesser or greater degree of desired electrical inductance.

Referring to FIGS. 18 through 25 together, the laminated electrically inductive device 2 according to a third possible embodiment again comprises multiple laminations 4. In this embodiment, each lamination 4 comprises multiple concentric first surface layer patterns 14*a*, 14*b* and 14*c* along the first surface 10, multiple concentric second layer patterns 22*a*, 22*b* and 22*c* along the second surface 12 and multiple coupling regions 26*a*, 26*b* and 26*c* there between. This embodiment allows for the laminated electrically inductive device 2 to become a multilayered inductive device with multiple turns in the form of an electrical inductor or transformer, depending on how the first surface patterns 14*a*, 14*b* and 14*c* and the second surface patterns 22*a*, 22*b* and 22*c* interconnect. In FIGS. 18 through 25, the first angle of rotation 18 and the second angle of rotation 24 for all the first surface layer patterns 14 and the second surface layer patterns 22 is approximately 270 degrees.

Figure 18:
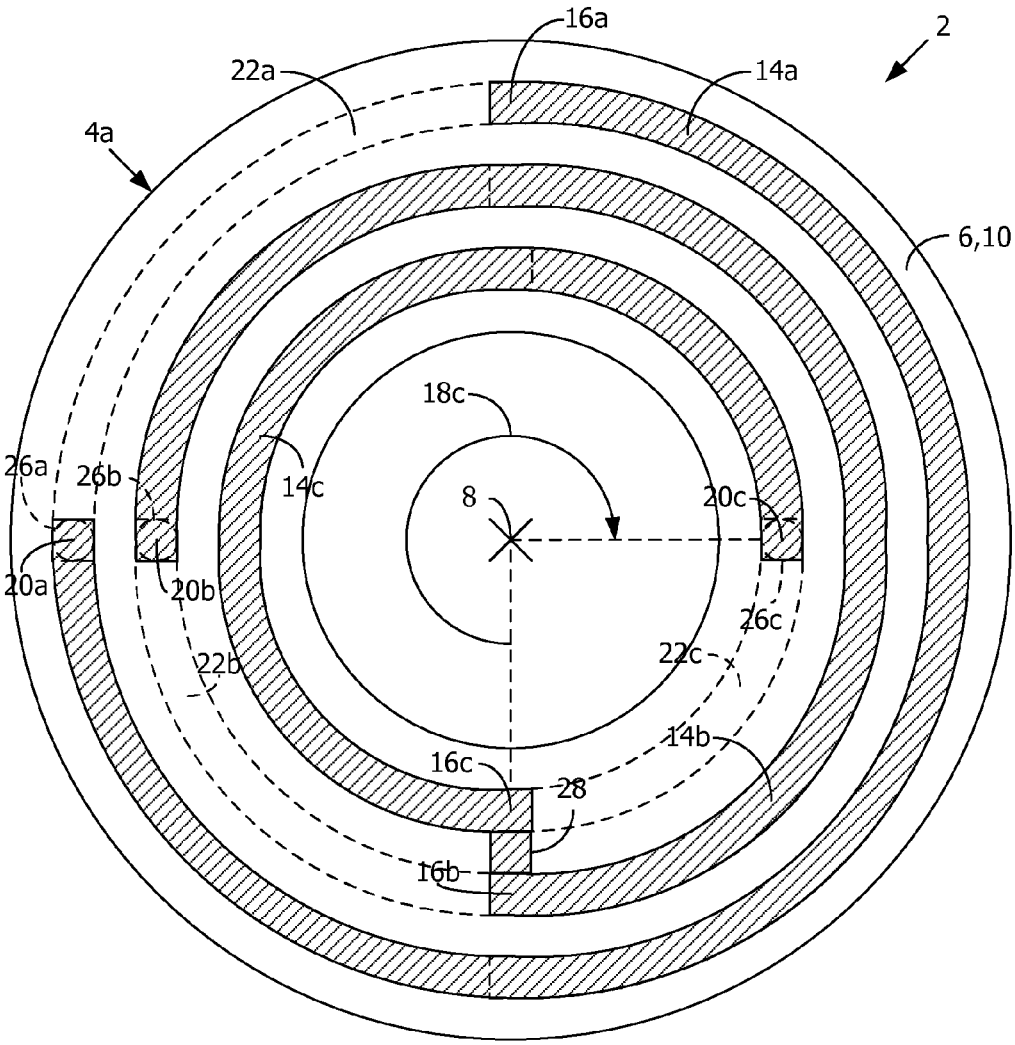
FIG. 18 is a top view of a first lamination of a laminated electrically inductive device according to a third embodiment.
Figure 19:
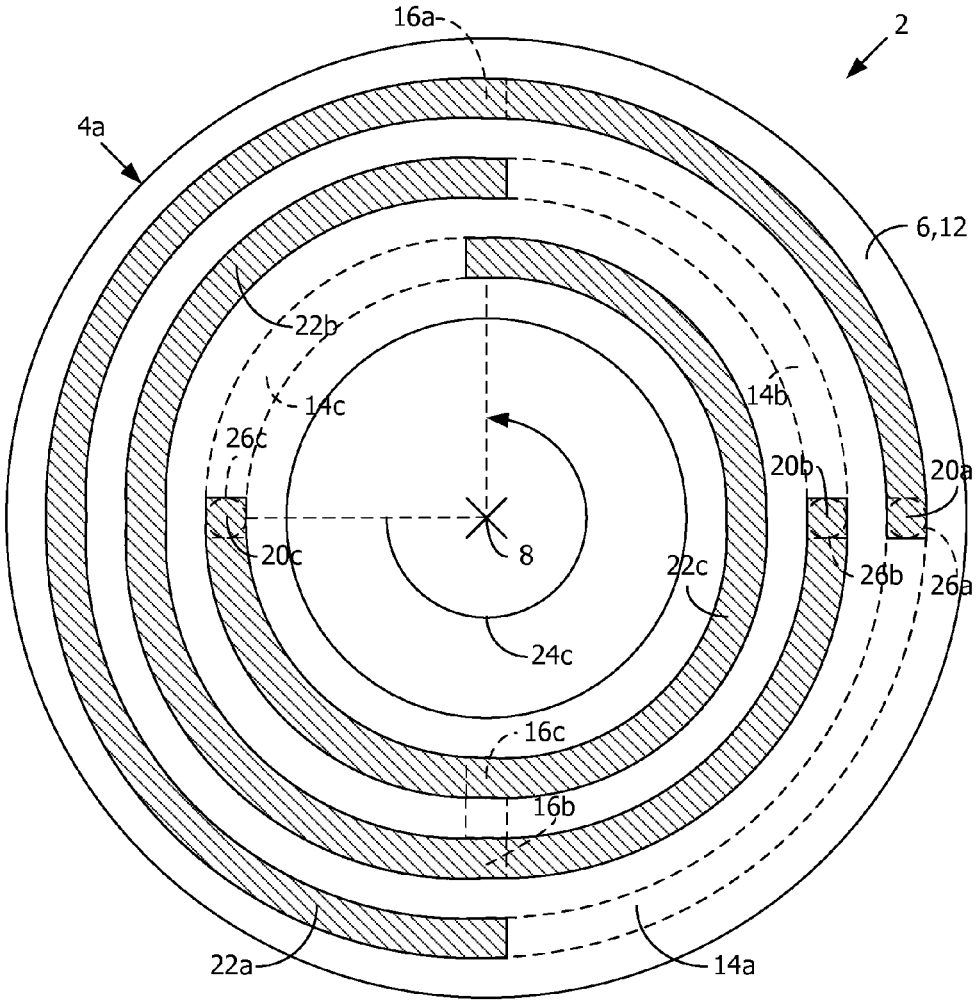
FIG. 19 is a bottom view of the first lamination of the third embodiment shown in FIG. 18.
Figure 20:
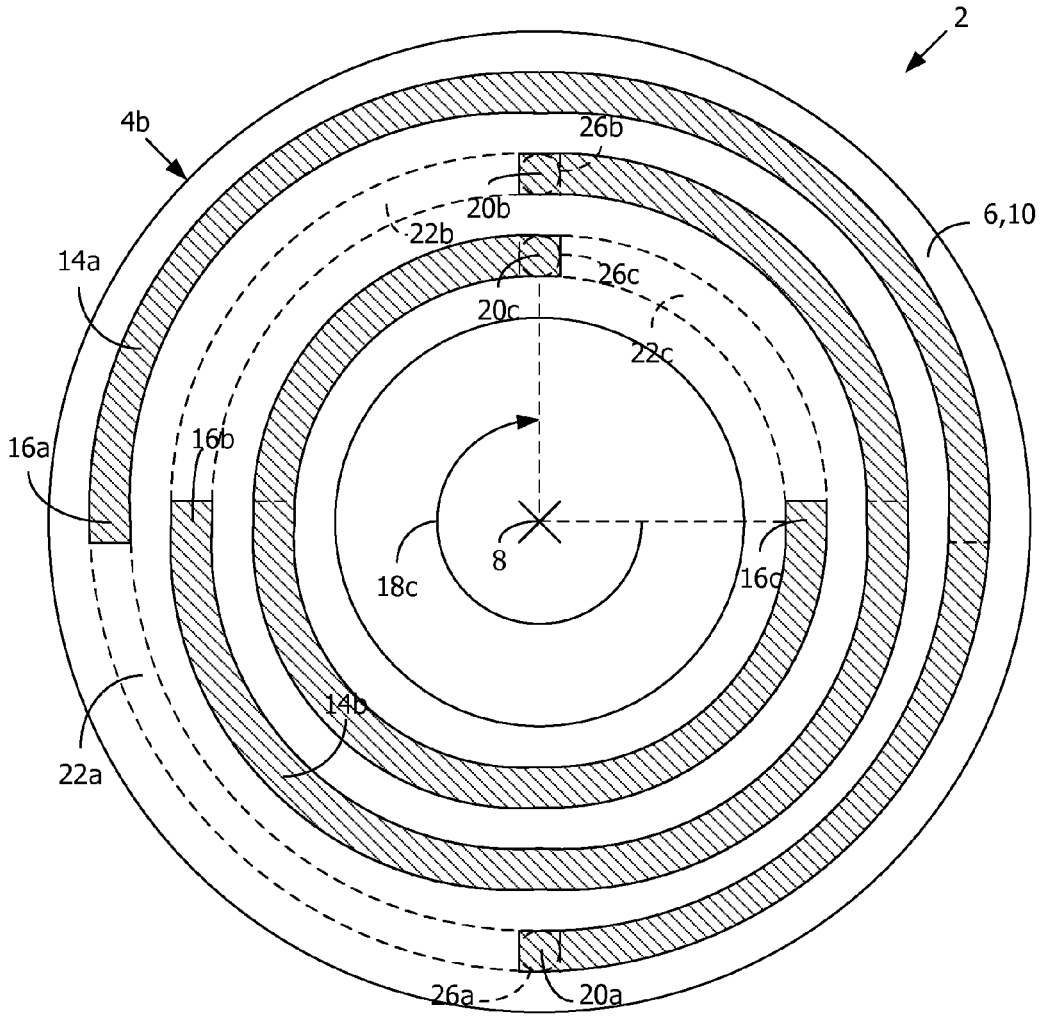
FIG. 20 is a top view of a second lamination of the third embodiment.
Figure 21:
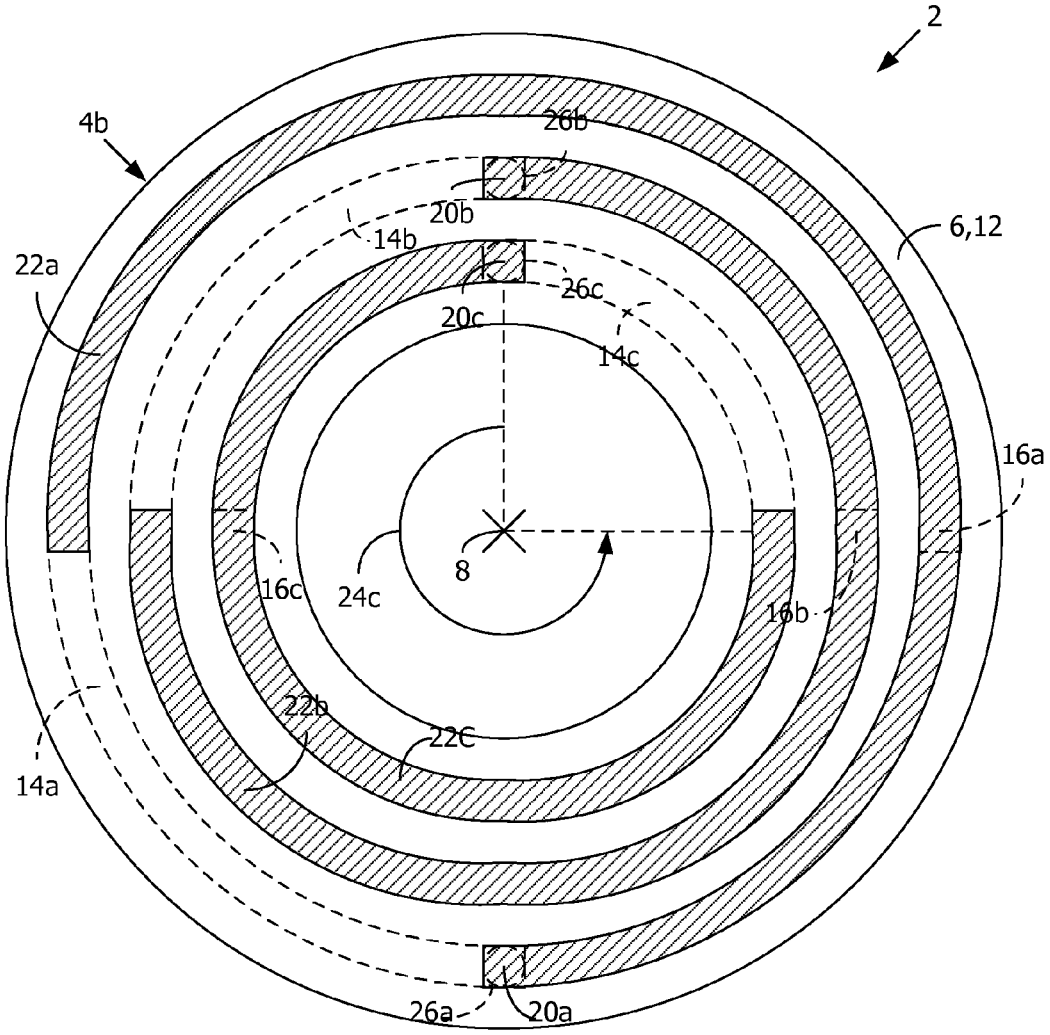
FIG. 21 is a bottom view of the second lamination of the third embodiment shown in FIG. 20.
Figure 22:
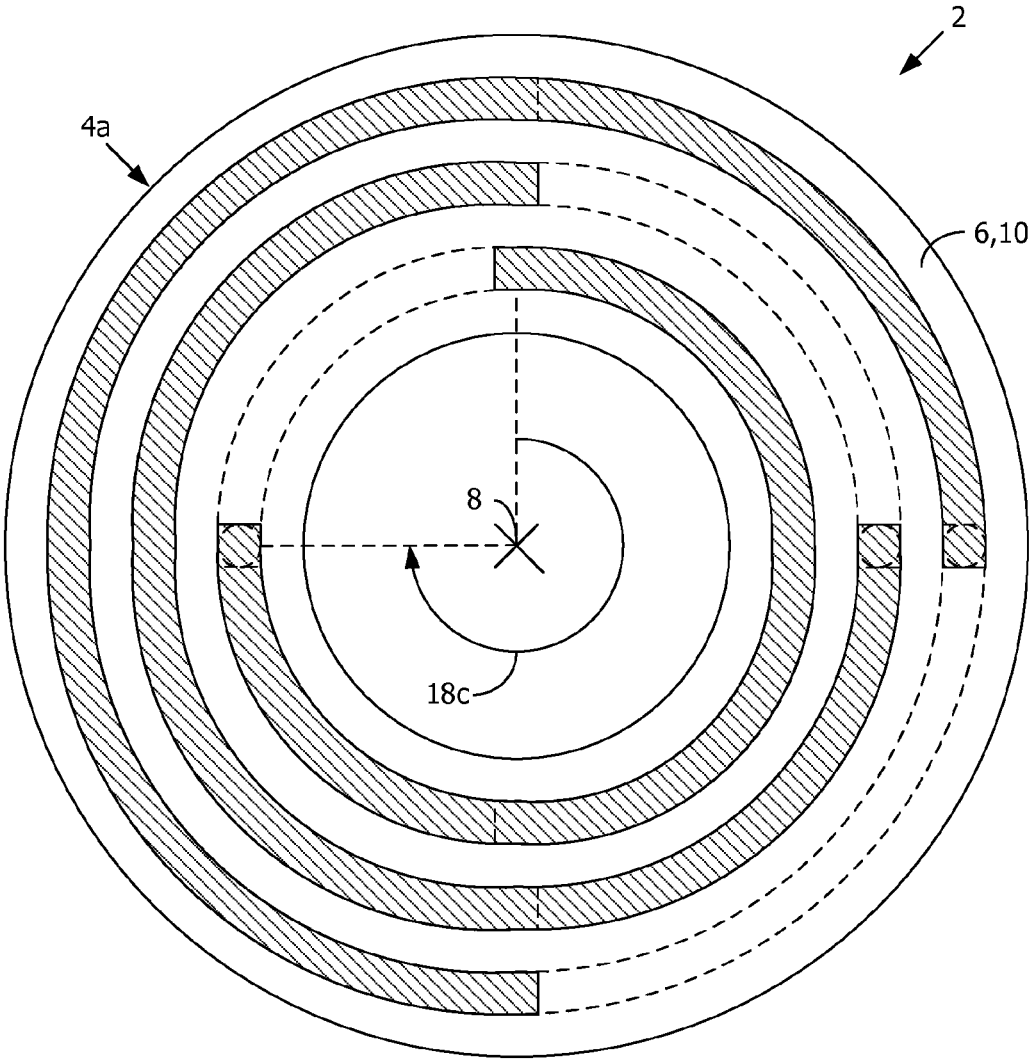
FIG. 22 is a top view of a third lamination of the third embodiment.
Figure 23:
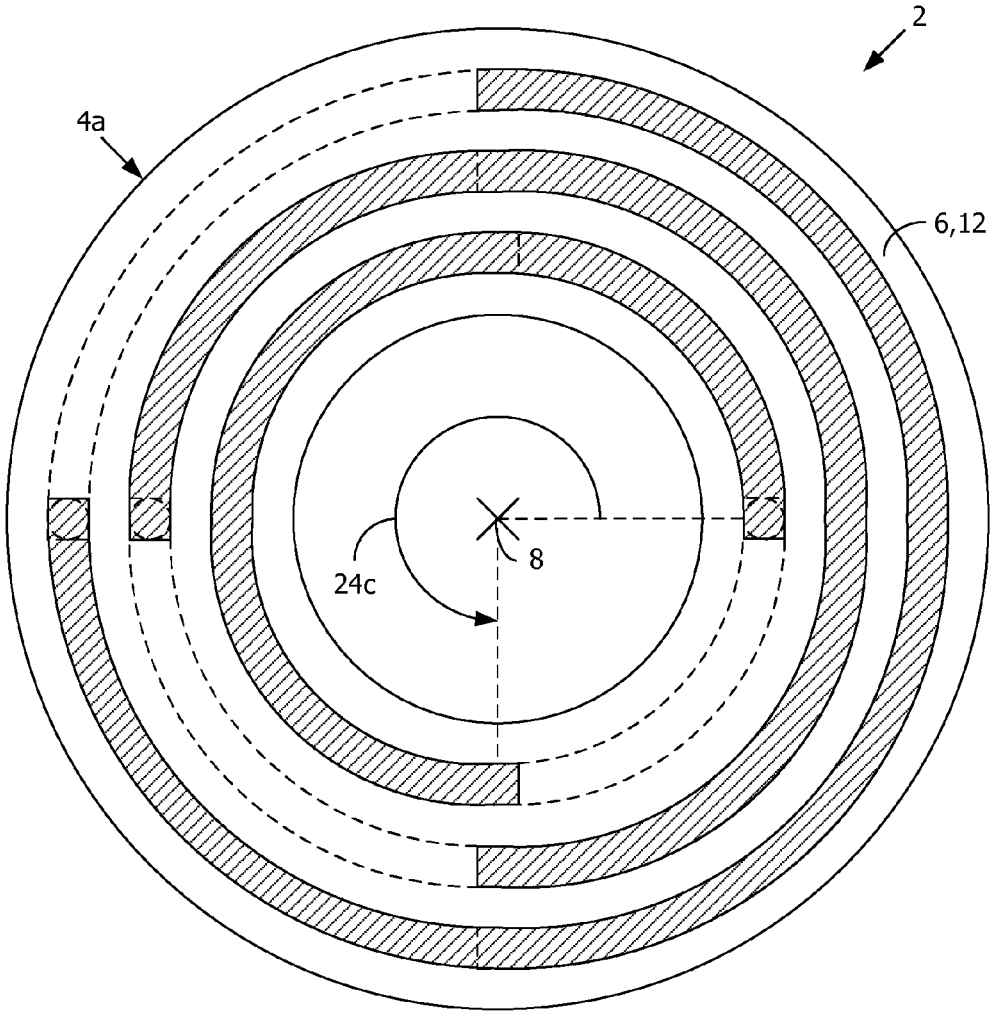
FIG. 23 is a bottom view of third lamination of the third embodiment shown in FIG. 22.
Figure 24:
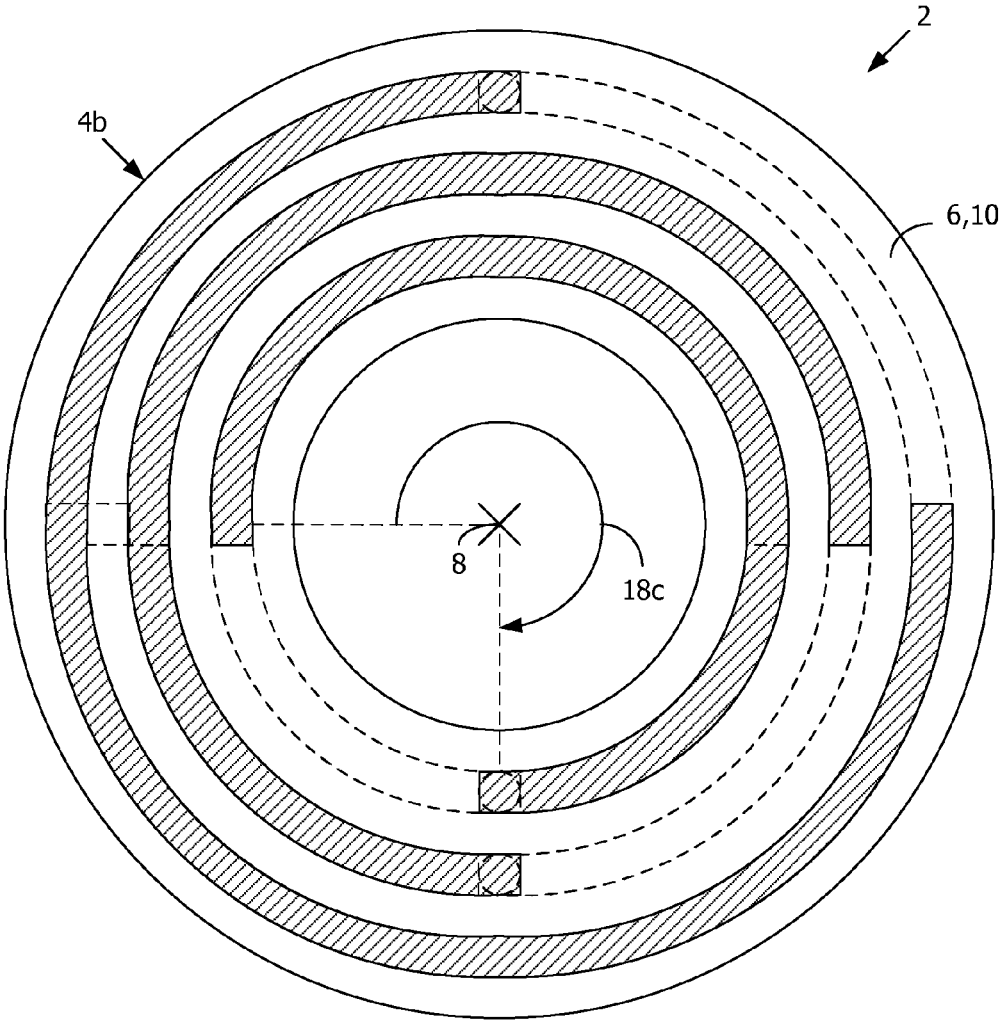
FIG. 24 is a top view of a fourth lamination of the third embodiment.
Figure 25:
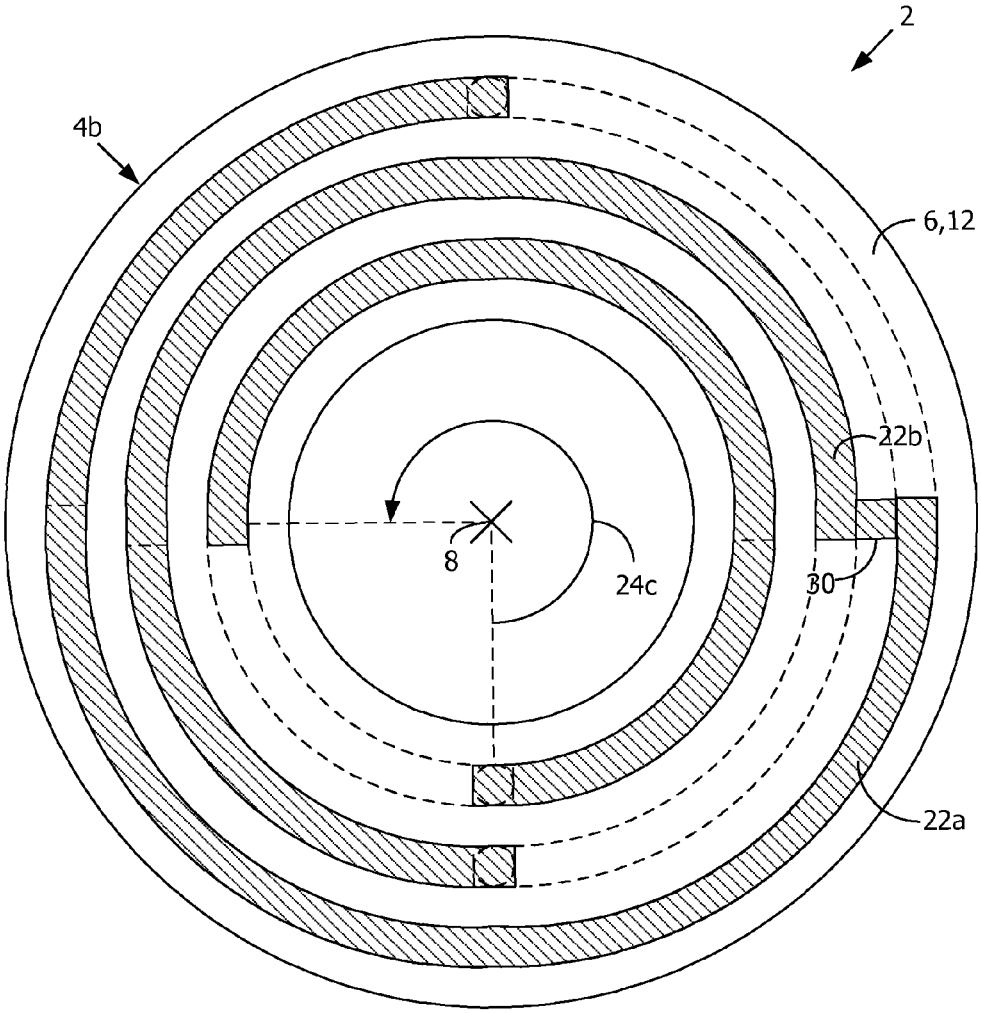
FIG. 25 is a bottom view of the fourth lamination of the third embodiment shown in FIG. 24.
Figure 26:
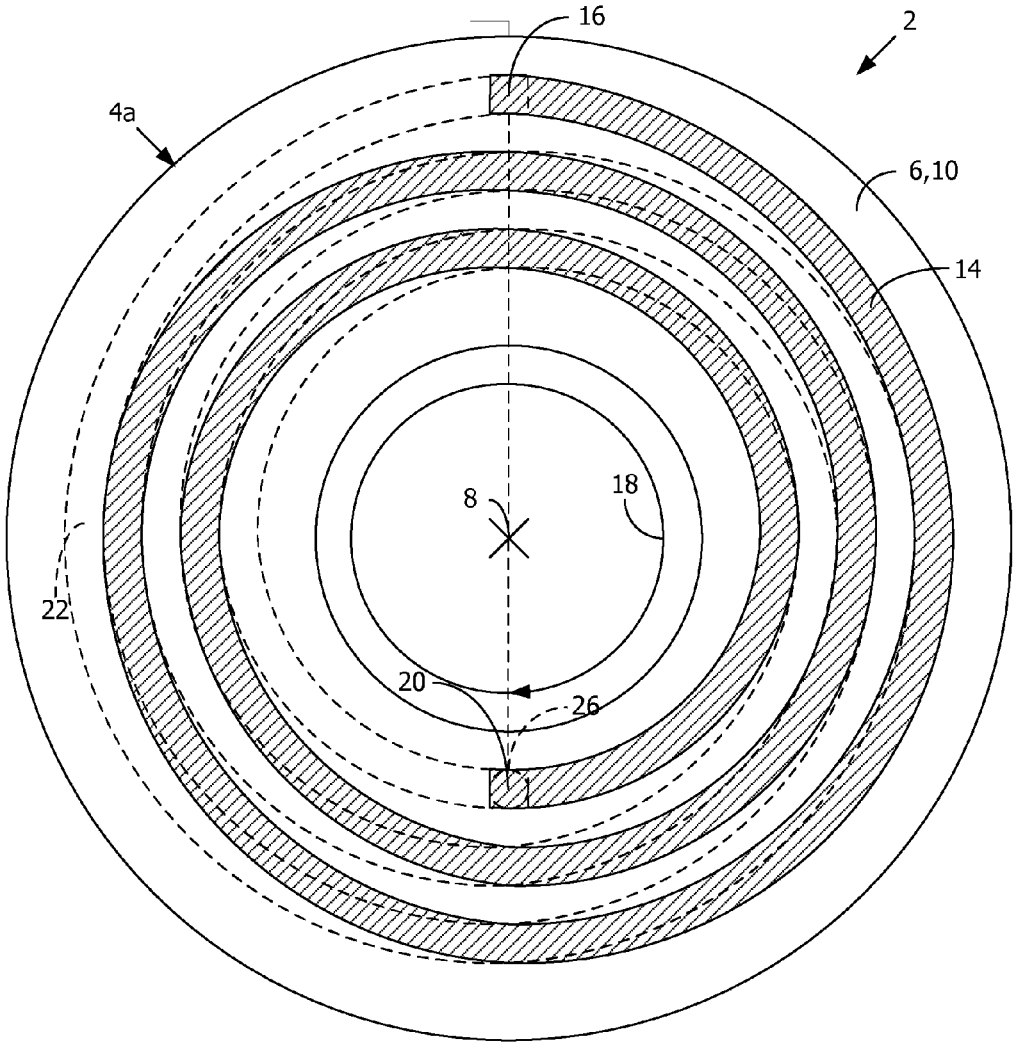
FIG. 26 is a top view of a first lamination of a laminated electrically inductive device according to a fourth embodiment.
Figure 27:
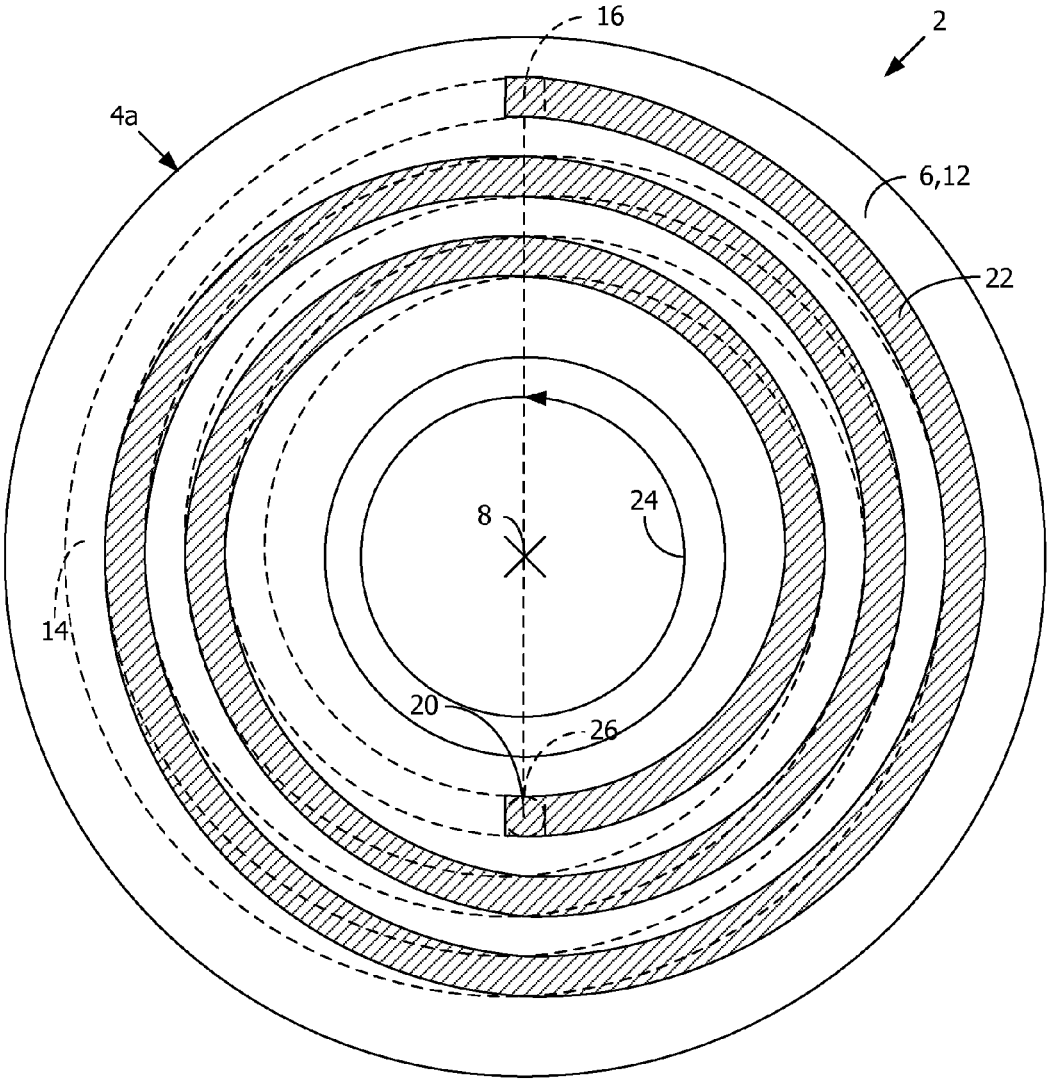
FIG. 27 is a bottom view of the first lamination of the fourth embodiment shown in FIG. 26.
Figure 28:
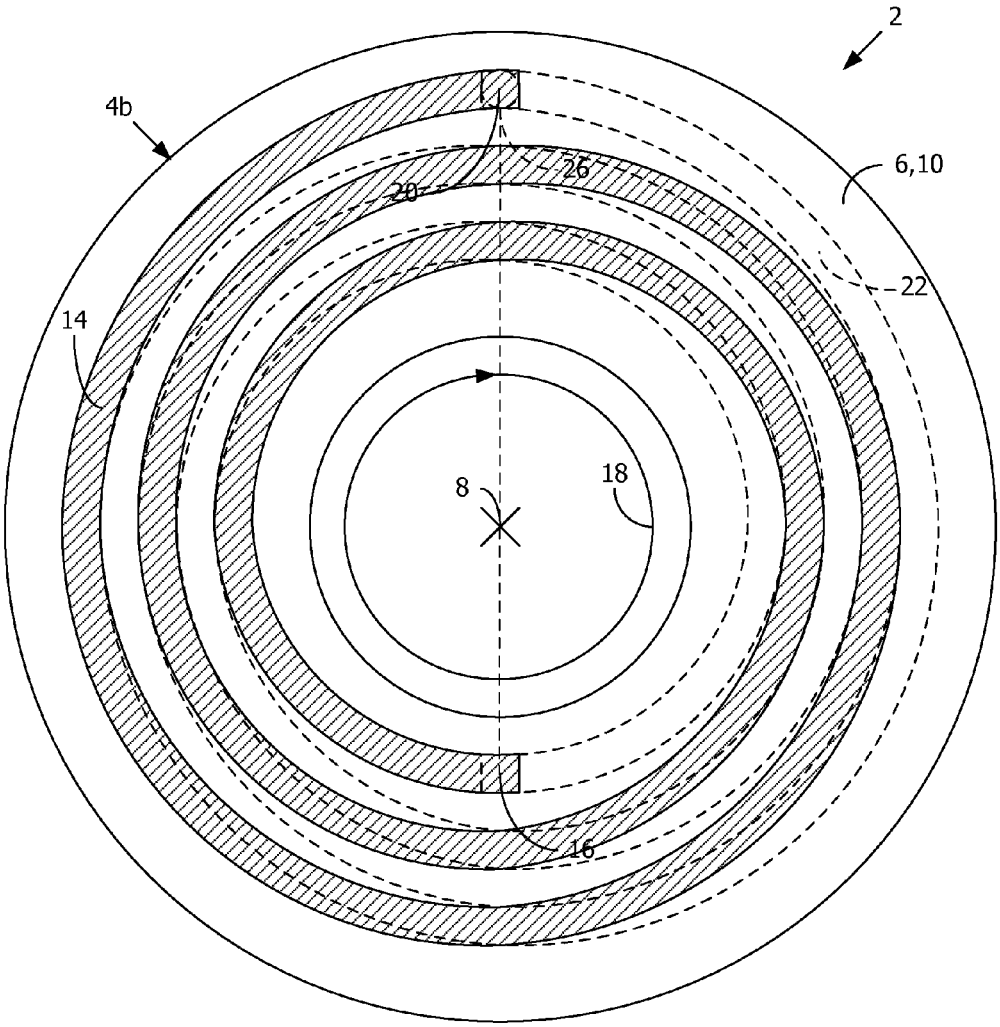
FIG. 28 is a top view of a second lamination of the fourth embodiment.
Figure 29:
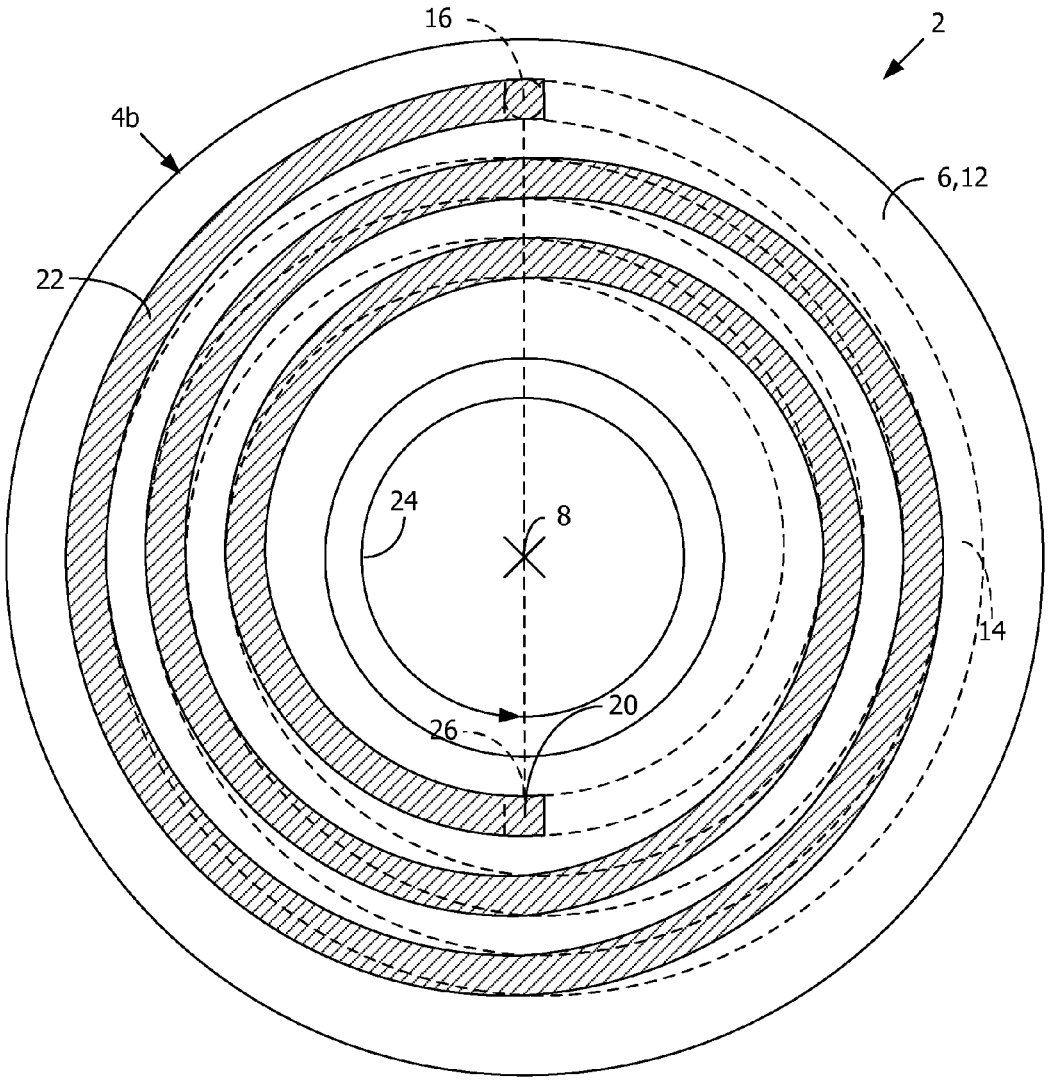
FIG. 29 is a bottom view of the second lamination of the fourth embodiment shown in FIG. 28.
Figure 30:
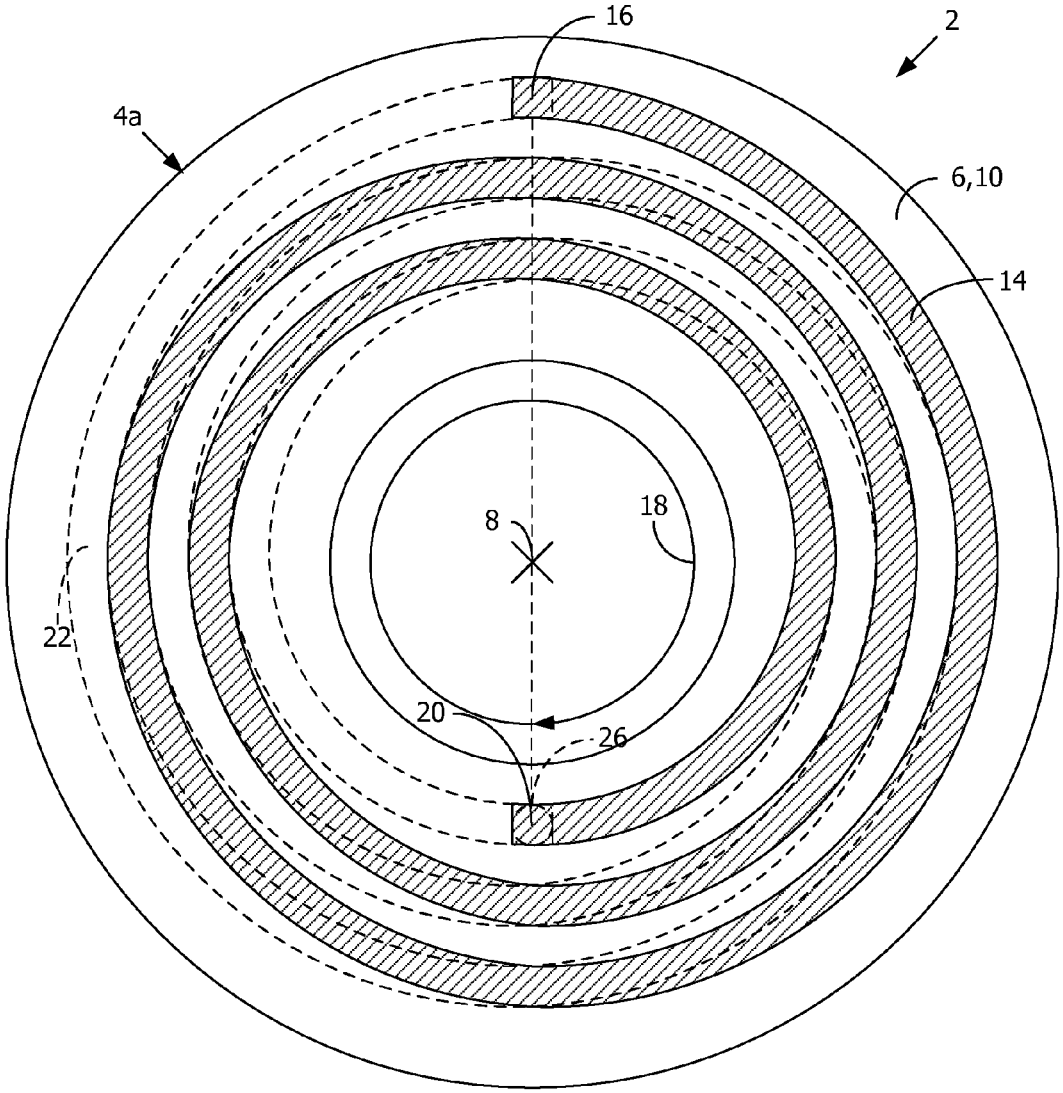
FIG. 30 is a top view of a third lamination of the fourth embodiment.
Figure 31:
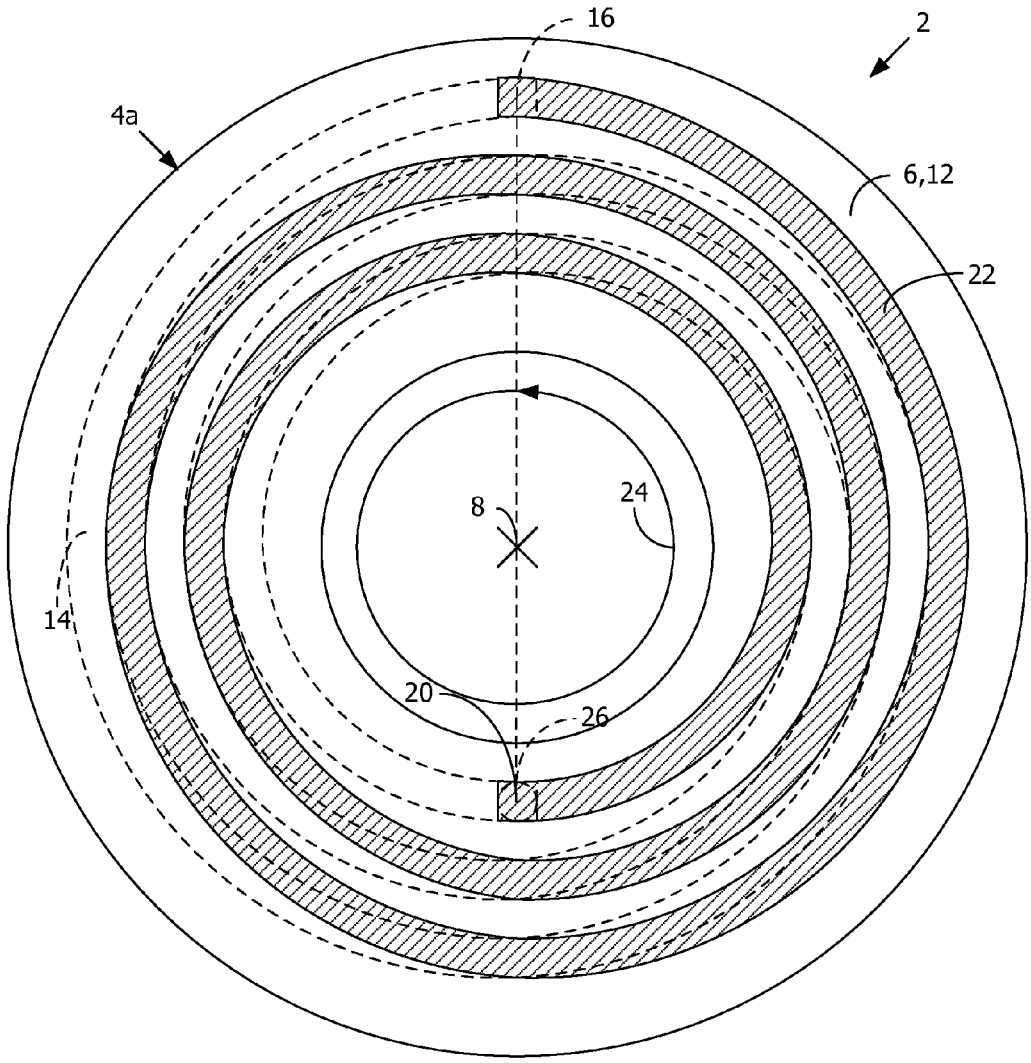
FIG. 31 is a bottom view of third lamination of the fourth embodiment shown in FIG. 30.
Figure 32:
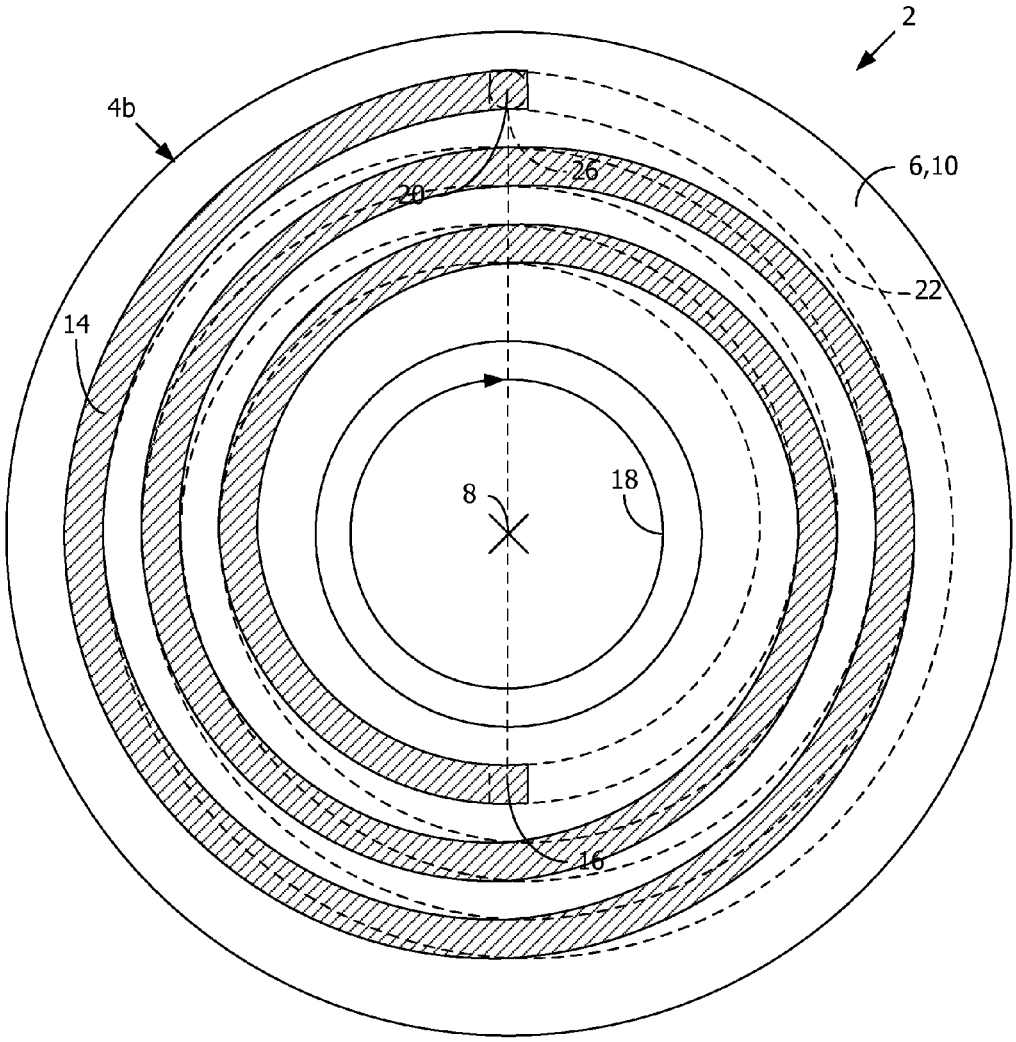
FIG. 32 is a top view of a fourth lamination of the fourth embodiment.
Figure 33:
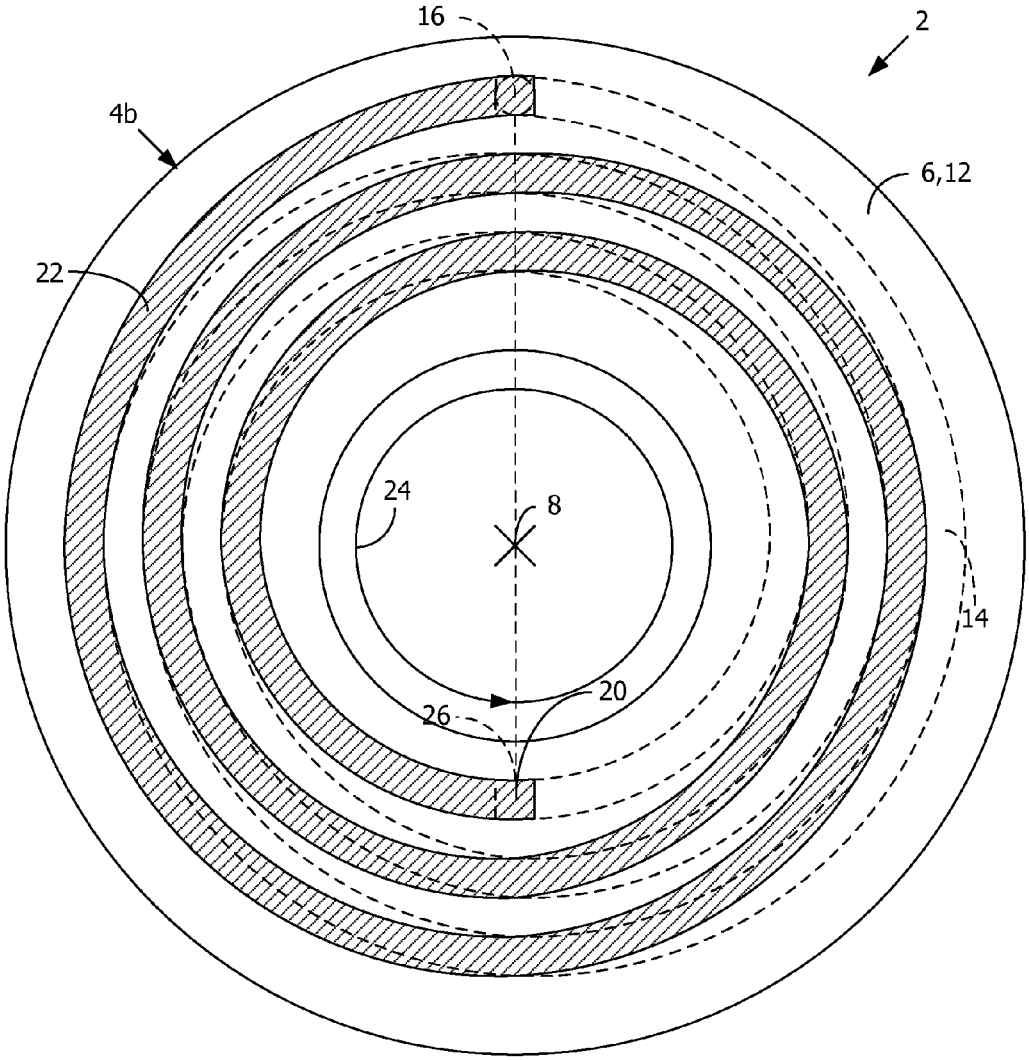
FIG. 33 is a bottom view of the fourth lamination of the fourth embodiment shown in FIG. 32.
Figure 34:
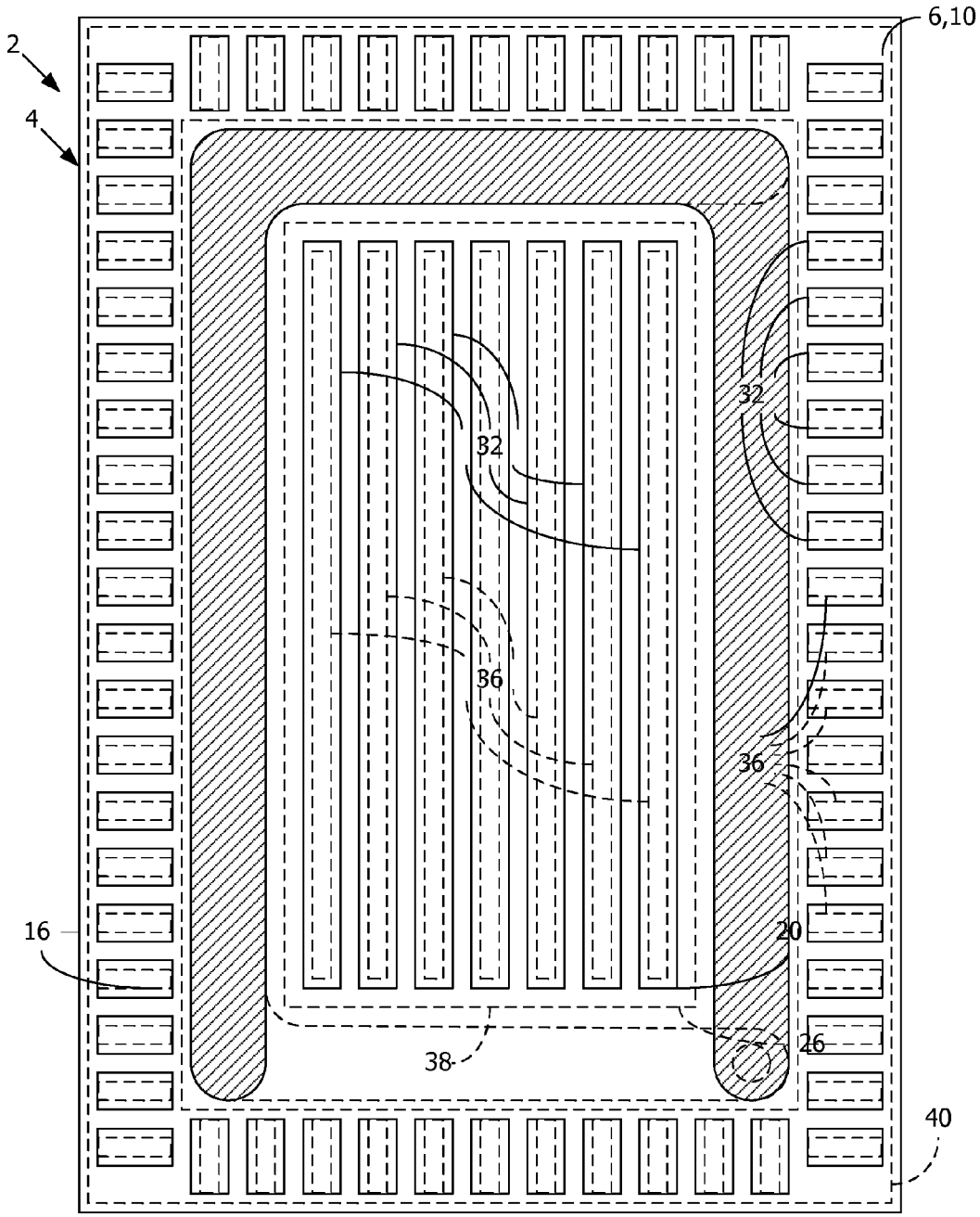
FIG. 34 is a top view of a first lamination of a laminated electrically inductive device according to a fifth embodiment.
Figure 35:
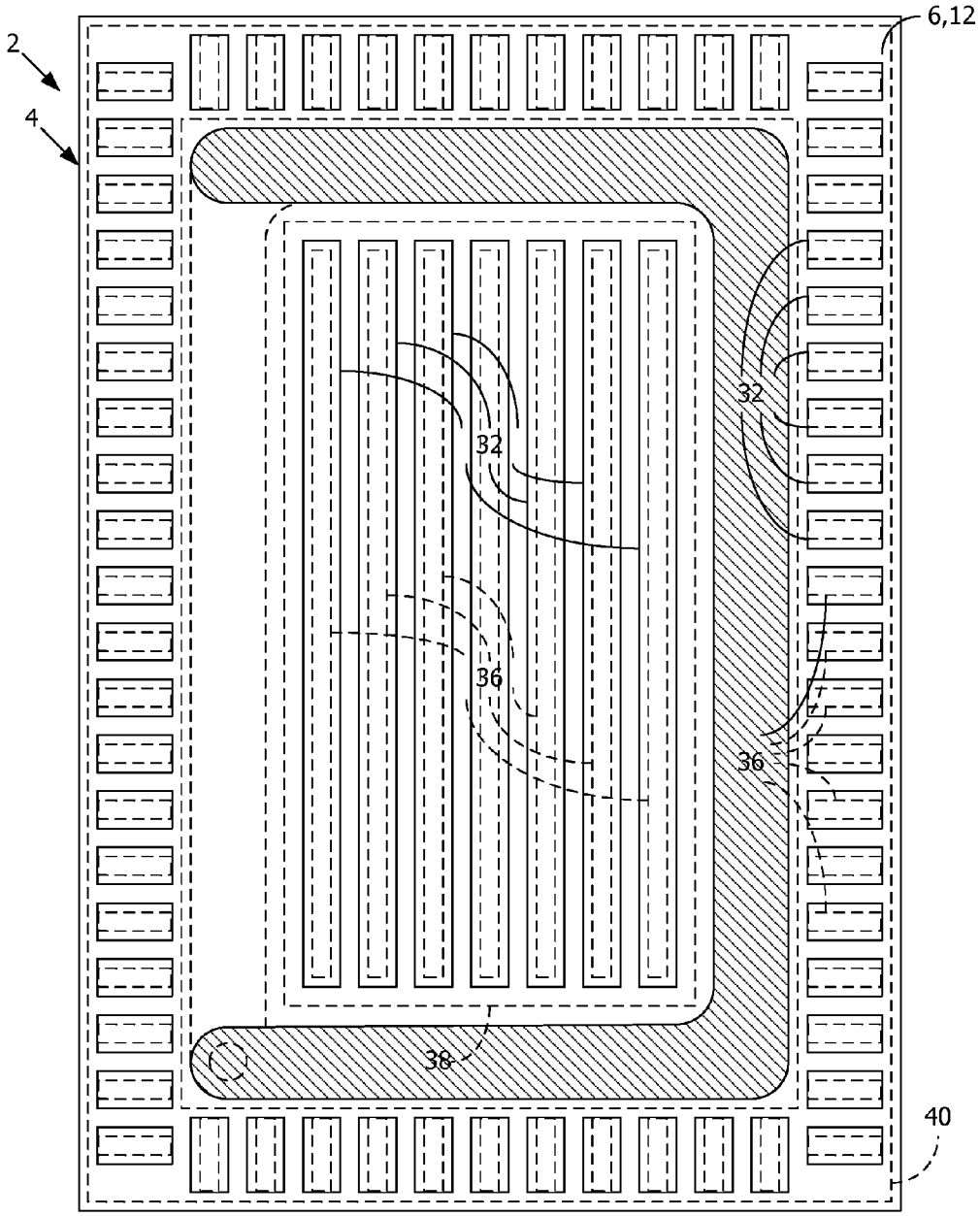
FIG. 35 is a bottom view of the first lamination of the fifth embodiment shown in FIG. 34.
Figure 36:
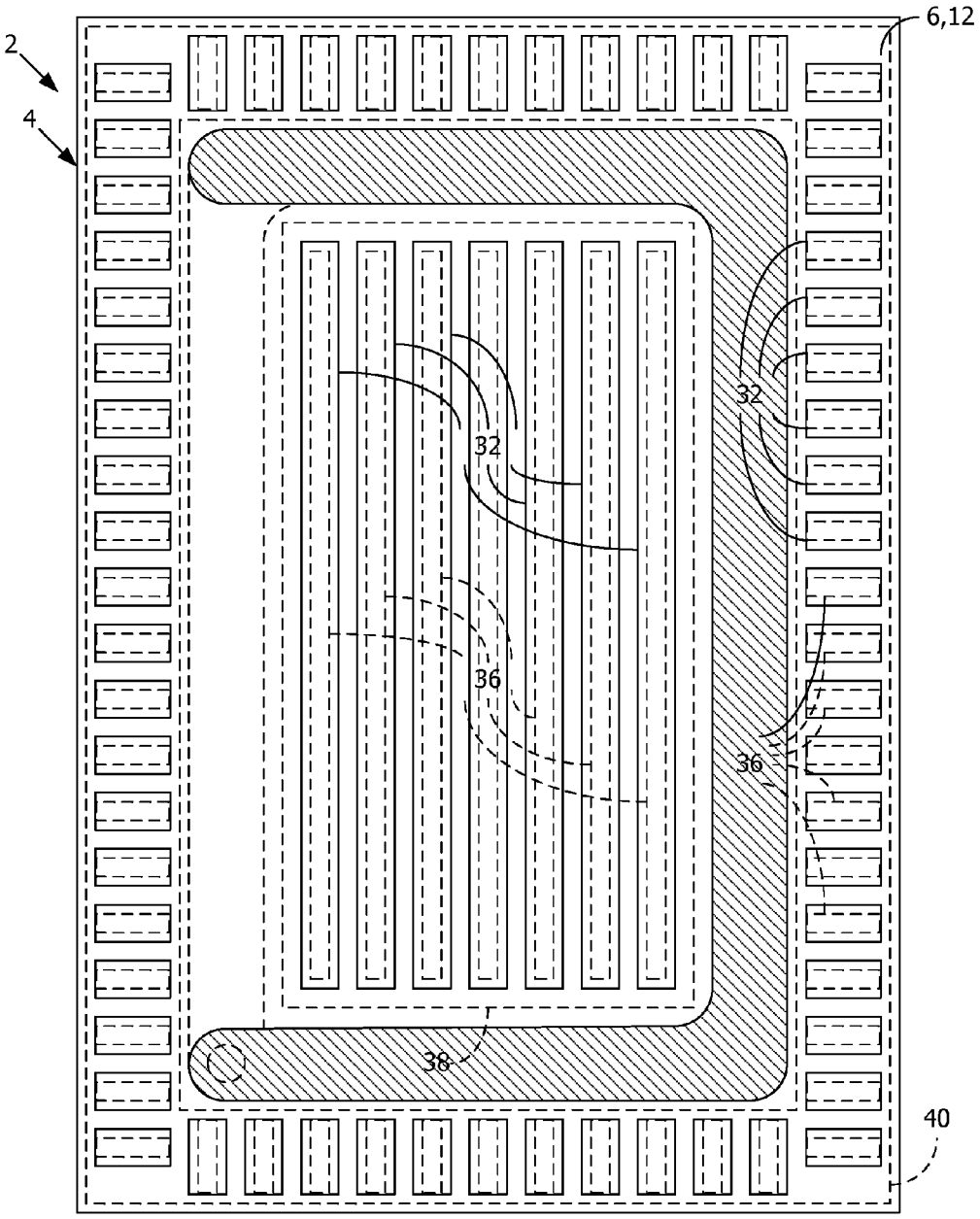
FIG. 36 is a top view of a second lamination of the fifth embodiment.
Figure 37:
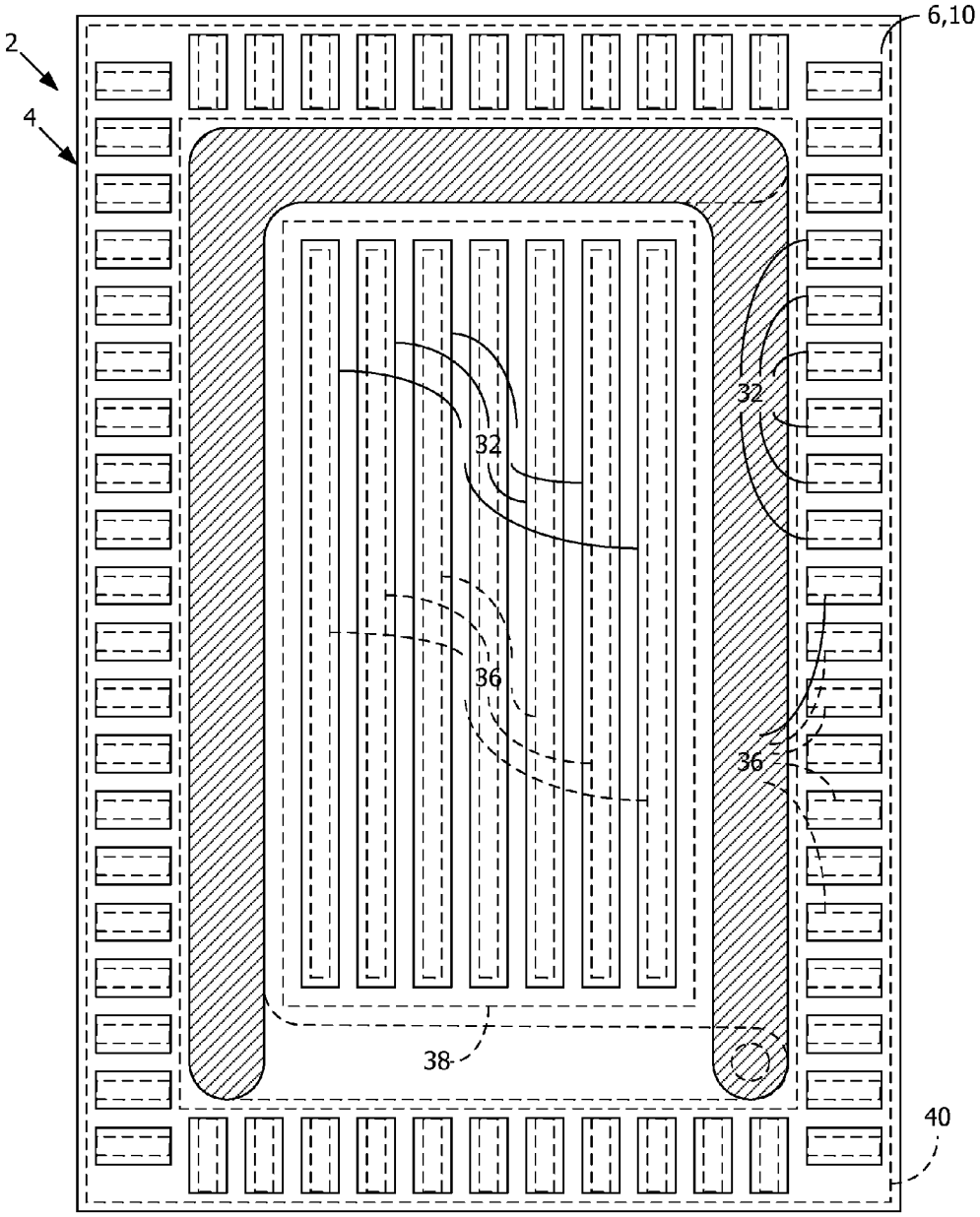
FIG. 37 is a bottom view of the second lamination of the fifth embodiment shown in FIG. 36.
Figure 38:
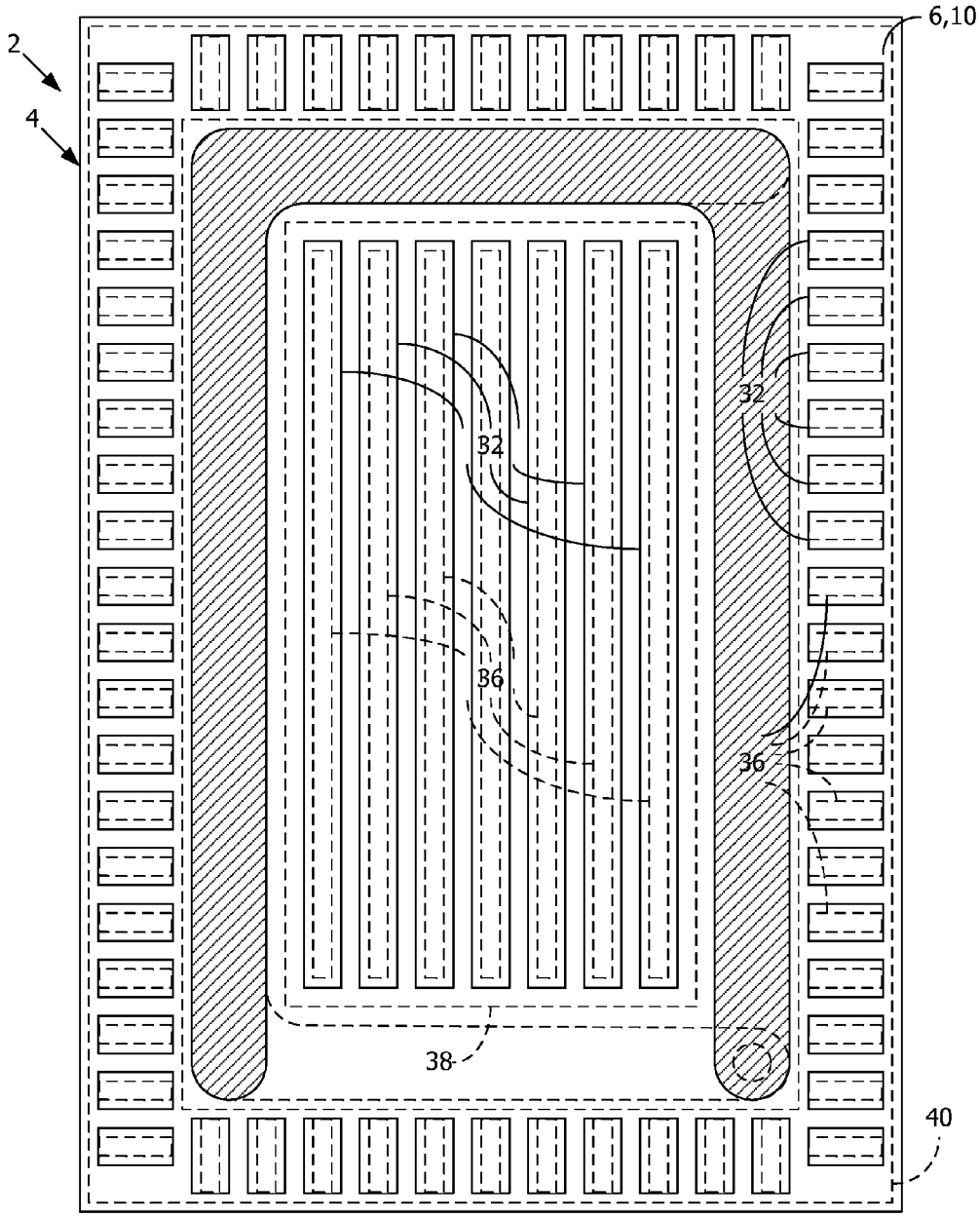
FIG. 38 is a top view of a third lamination of the fifth embodiment.
Figure 39:
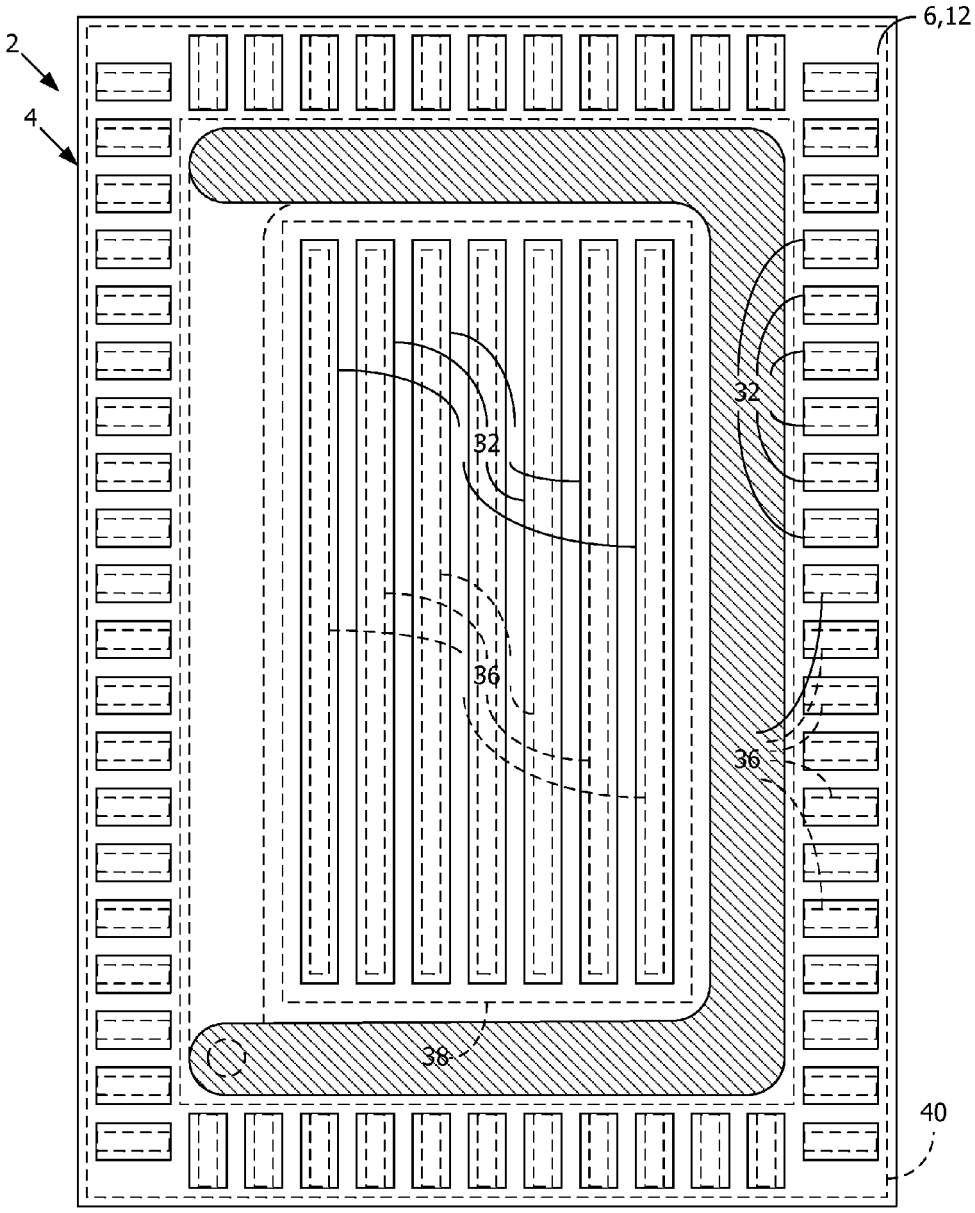
FIG. 39 is a bottom view of third lamination of the fifth embodiment shown in FIG. 38.
Figure 40:
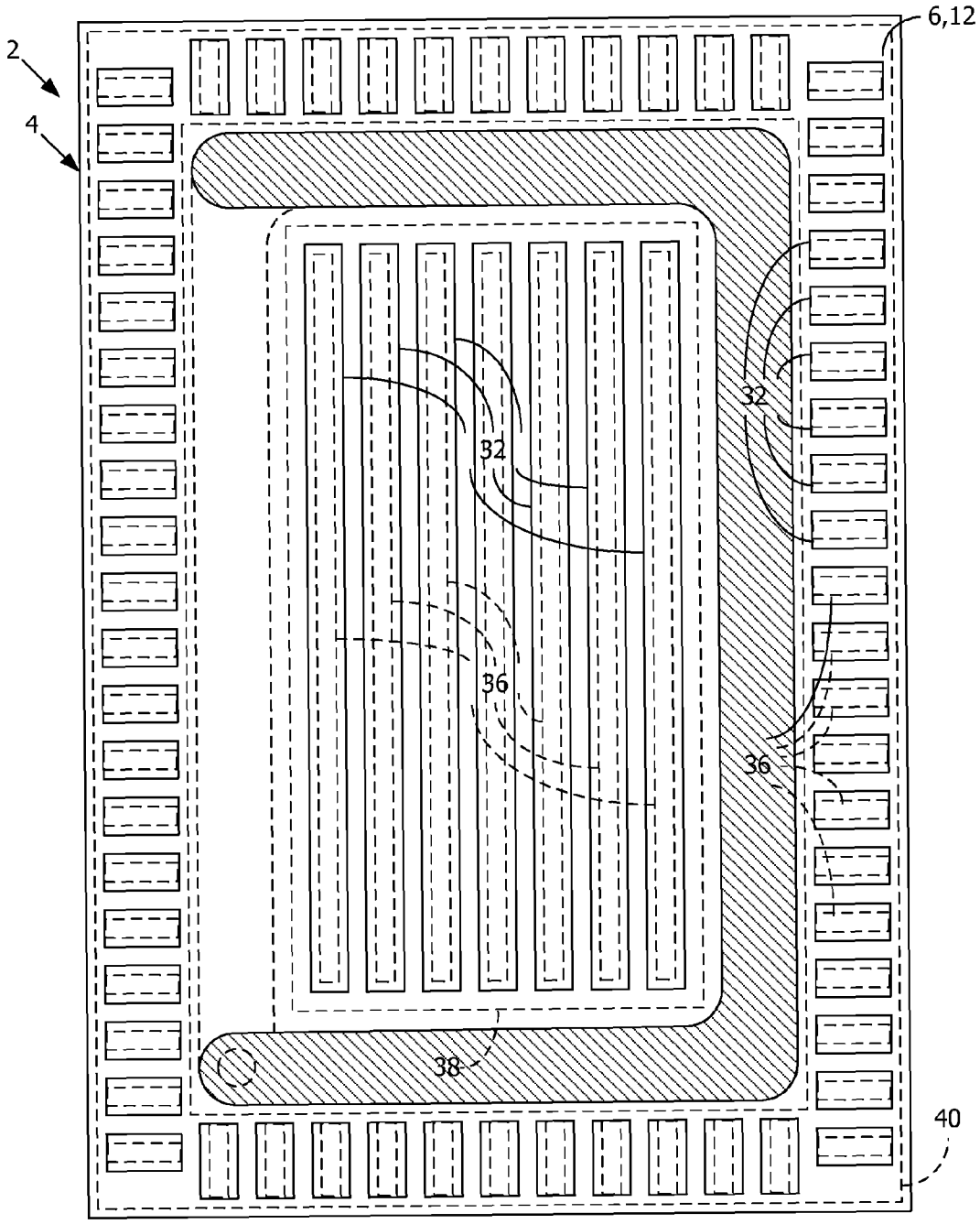
FIG. 40 is a top view of a fourth lamination of the fifth embodiment.
Figure 41:
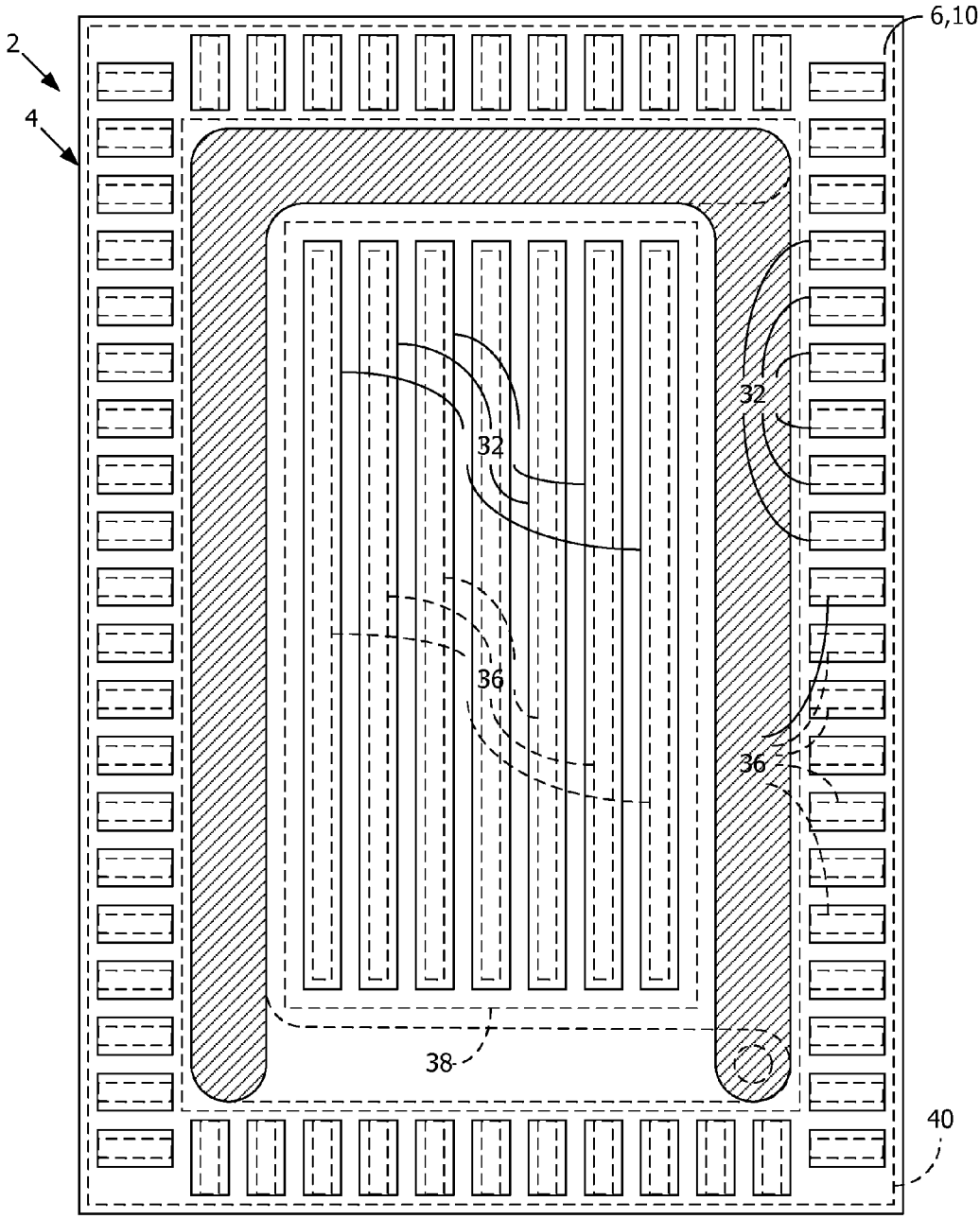
FIG. 41 is a bottom view of the fourth lamination of the fifth embodiment shown in FIG. 40.

For this embodiment two types of laminations 4 are present, represented by laminations 4*a* and 4*b*. They have complementary arrangements of their first surface patterns 14*a*, 14*b* and 14*c* and second surface patterns 22*a*, 22*b* and 22*c* so that when arranged in a stack of laminations represented by 4*a*, 4*b*, 4*a*, 4*b*, and so forth, as shown in FIGS. 18 through 25, the windings that they represent may allow electrical current flow in a single direction when a first intra-pattern link 28 couples the first surface pattern 14*b* with the first surface pattern 14*c* of an outermost lamination 4*a*, as shown in FIG. 18, and a second intra-pattern link 30 couples the second surface pattern 22*a* with the second surface pattern 22*b* of an outermost lamination 4*b*, as shown in FIG. 25.

The intra-pattern links 28 and 30 may comprise any convenient plating, cladding or film applied to the substrate 6, such as copper, aluminium or any alloy thereof. Inclusion of both the intra-pattern links 28 and 30 will result in the laminated electrically inductive device 2 having the form of an electrical inductor with a three-layer winding of four turns each. Removal of either the first intra-pattern link 28 or the second inter-pattern link will result in the laminated electrically inductive device 2 having the form of an electrical transformer that comprises a single layer primary with four turns and a two layer secondary with a total of eight turns.

Referring to FIGS. 26 through 33 together, the laminated electrically inductive device 2 according to a fourth possible embodiment again comprises multiple laminations 4. In this embodiment, each lamination 4 comprises a first surface layer pattern 14 along the first surface 10 that extends through the first angle of rotation 18 and the second surface layer pattern 22 extends through the first angle of rotation 24, with both the first angle of rotation 18 and the second angle of rotation 24 exceeding 360 degrees to let the first surface layer pattern 14 and the second surface layer pattern 22 assume generally spiral figures. In FIGS. 26 through 33 the first angle of rotation 18 and the second angle of rotation 24 are approximately 360 plus 270, or 630 degrees.

For this embodiment two types of laminations 4 are present, represented by laminations 4*a* and 4*b*. They have complementary arrangements of their first surface patterns 14 and second surface patterns 22 so that when arranged in a stack of laminations represented by 4*a*, 4*b*, 4*a*, 4*b*, and so forth, as shown in FIGS. 26 through 33, the windings that they represent may allow electrical current flow in a single direction. With this arrangement, the fourth embodiment as shown in FIGS. 26 through 33 will result in the laminated electrically inductive device 2 having the form of an electrical inductor with a three-layer winding of four turns each. Of course, the laminated electrically inductive device 2 may have additional laminations 4 and the first angle of rotation 18 and the second angle of rotation 24 may be greater than 630 degrees to achieve an electrical inductance with a greater number of windings and layers. Furthermore, the laminated electrically inductive device 2 may have laminations 4 that comprise multiple concentric first surface layers 14 and second layers 22, all assuming the spiral form, to achieve additional electrical inductance or transformer operation.

Referring to FIGS. 34 through 41 together, the laminated electrically inductive device 2 according to a fifth possible embodiment again comprises multiple laminations 4. This embodiment is electrically identical to the first embodiment as described in connection with FIGS. 1 through 9, but it includes additional magnetic circuit elements. Specifically, each lamination 4 includes at least one first magnetically permeable layer pattern 32 along the first surface 10 of the substrate 6, at least one magnetically permeable layer pattern 34 along the second surface 12 of the substrate 6 and at least one magnetically permeable coupling region 36 passing through the substrate 6 that magnetically couples the first magnetically permeable layer pattern 34 to the second magnetically permeable layer 36.

The first surface magnetically permeable pattern 32 and the second surface magnetically permeable pattern may 34 comprise any convenient magnetically permeable plating, cladding or film applied to the substrate 6, such as a ferrous or ferrite material. The magnetically permeable coupling region 36 may simply be an aperture that allows the first magnetically permeable surface pattern 32 to contact the second magnetically permeable surface pattern 34, or it may otherwise be a magnetically permeable inlay in the substrate 6 or even a magnetically permeable connecting member that passes through an aperture in the substrate 6.

As shown in FIGS. 34 through 41, the first magnetically permeable surface patterns 32, the second magnetically permeable surface patterns 34 and the magnetically permeable coupling regions 36 may assume the shape of narrow strips to form magnetically permeable laminations to reduce eddy current effects. Furthermore, as also shown, the first magnetically permeable surface patterns 32, the second magnetically permeable surface patterns 34 and the magnetically permeable coupling regions 36 may form a magnetically permeable core region 38 within the winding of the laminated electrically inductive device 2 or a magnetically permeable shield region 40 outside of the winding of the laminated electrically inductive device 2. Furthermore, magnetically permeable shunts (not shown) may connect the magnetically permeable core region 38 with the magnetically permeable shield region 40 along the exterior surfaces of the laminated electrically inductive device 2 to let it become a highly inductive, magnetically shielded inductor with a closed magnetic circuit.

The described embodiments as set forth herein represent only illustrative implementations of the invention as set forth in the attached claims. Changes and substitutions of various details and arrangement thereof are within the scope of the claimed invention.

The invention claimed is:

1. An electrically inductive device that comprises multiple laminations, each lamination comprising:

a generally planar electrically nonconductive substrate that has a central axis normal to the plane of the substrate, a first surface and a second surface;

at least one electrically conductive layer pattern along the first surface in the form of a narrow strip that starts from a first point displaced from the central axis by a distance and extends along the first surface about the central axis through a first angle of rotation to a second point displaced from the central axis by the distance;

at least one electrically conductive layer pattern along the second surface in the form of a narrow strip that starts from the second point displaced from the central axis by the distance and extends along the second surface about the central axis through a second angle of rotation to at least the first point displaced from the central axis by the distance;

an electrically conductive coupling region passing through the substrate proximate the second point that couples the electrically conductive layer pattern along the first surface to the electrically conductive layer pattern along the second surface;

wherein stacking the laminations upon each other form at least one winding with multiple turns for the inductive device; and adjacent laminations have the electrically conductive layer pattern of their first surfaces and the electrically conductive layer pattern of their second surfaces mating.

2. The inductive device of claim 1, wherein the inductive device comprises an inductor.

3. The inductive device of claim 1, wherein the inductive device comprises a transformer.

4. The inductive device of claim 1, wherein the electrically conductive layer pattern along the first surface and the electrically conductive layer pattern along the second surface form a closed planar figure.

5. The inductive device of claim 4, wherein the closed planar figure has multiple rectilinear outer sides.

6. The inductive device of claim 4, wherein the closed planar figure has at least a curvilinear outer side.

7. The inductive device of claim 4, wherein the first angle of rotation and the second angle of rotation are each within a range of approximately 180 and nearly 360 degrees.

8. The inductive device of claim 4, wherein the laminations are of a single type.

9. The inductive device of claim 8, wherein the electrically conductive layer pattern along the first surface is symmetric with the electrically conductive layer pattern along the second surface.

10. The inductive device of claim 8, wherein the electrically conductive layer pattern along the first surface is nonsymmetric with the electrically conductive layer pattern along the second surface.

11. The inductive device of claim 1, wherein each lamination comprises multiple concentric layer patterns along the first surface, multiple concentric layer patterns along the second surface and multiple coupling regions there between to form a multilayered inductive device with multiple turns.

12. The inductive device of claim 11, wherein adjacent laminations have mating complimentary concentric layer patterns on their surfaces.

13. The inductive device of claim 1, further comprising:

at least one magnetically permeable layer pattern along the first surface;

a least one magnetically permeable layer pattern along the second surface that is in general alignment with the magnetically permeable layer pattern along the first surface;

at least one magnetically permeable coupling region passing through the substrate that couples the magnetically permeable layer pattern along the first surface to the magnetically permeable layer pattern along the second surface.

14. The inductive device of claim 13, wherein the laminated magnetically permeable patterns form a magnetic core for the inductive device.

15. The inductive device of claim 13, wherein the laminated magnetically permeable patterns form a magnetic shell for the inductive device.

16. An electrical inductor that comprises multiple laminations, each lamination comprising:

a generally planar electrically nonconductive substrate that has a central axis normal to the plane of the substrate, a first surface and a second surface;

at least one electrically conductive layer pattern along the first surface in the form of a narrow strip that starts from a first point displaced from the central axis by a distance and extends along the first surface about the central axis through a first angle of rotation to a second point displaced from the central axis by the distance;

at least one electrically conductive layer pattern along the second surface in the form of a narrow strip that starts from the second point displaced from the central axis by the distance and extends along the second surface about the central axis through a second angle of rotation to at least the first point displaced from the central axis by the distance; and an electrically conductive coupling region passing through the substrate proximate the second point that couples the electrically conductive layer pattern along the first surface to the electrically conductive layer pattern along the second surface;

wherein stacking the laminations upon each other form a winding with multiple turns for the inductor; and adjacent laminations have the electrically conductive layer pattern of their first surfaces and the electrically conductive layer pattern of their second surfaces mating.

17. The inductor of claim 16, wherein each lamination comprises multiple concentric layer patterns along the first surface, multiple concentric layer patterns along the second surface and multiple coupling regions there between to form a winding with multiple turns per layer for the inductor.

18. The inductor of claim 17, wherein adjacent laminations have mating complimentary concentric layer patterns on their surfaces.

* * * * *